US010479118B2

(12) United States Patent
Arakane

(10) Patent No.: US 10,479,118 B2
(45) **Date of Patent: *Nov. 19, 2019**

(54) INK-JET PRINTER

(71) Applicant: BROTHER KOGYO KABUSHIKI KAISHA, Nagoya-shi, Aichi-ken (JP)

(72) Inventor: Satoru Arakane, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/158,473

(22) Filed: Oct. 12, 2018

(65) Prior Publication Data

US 2019/0105926 A1 Apr. 11, 2019

Related U.S. Application Data

(63) Continuation of application No. 15/696,449, filed on Sep. 6, 2017, now Pat. No. 10,099,491.

(30) Foreign Application Priority Data

Sep. 8, 2016 (JP) ..... 2016-175448

(51) Int. Cl.
*B41J 25/00* (2006.01)
*B41J 2/01* (2006.01)
(Continued)

(52) U.S. Cl.
CPC ..... *B41J 25/001* (2013.01); *B41J 2/01* (2013.01); *B41J 2/16508* (2013.01);
(Continued)

(58) Field of Classification Search
CPC ..... B41J 2/01; B41J 2/16508; B41J 2/16526; B41J 2/1707; B41J 2002/16573;
(Continued)

(56) References Cited

U.S. PATENT DOCUMENTS 5,912,681 A * 6/1999 Uetuki ..... B41J 2/16508 347/29
2001/0020962 A1 9/2001 Kanaya et al.
(Continued)

FOREIGN PATENT DOCUMENTS

JP 2001-180007 A 7/2001
JP 2007-245619 A 9/2007

*Primary Examiner* — Thinh H Nguyen
(74) *Attorney, Agent, or Firm* — Merchant & Gould P.C.

(57) ABSTRACT

There is provided an ink-jet printer including a conveyer, a recording head, a carriage, an ink receiver and a controller. The controller executes: receiving a recording instruction; determining an ink amount to be jetted in a flushing process; moving the carriage in a first orientation up to a returning position corresponding to the ink amount; moving the carriage in a second orientation opposite to the first orientation from the returning position to a sheet facing area; executing a flushing processing; and executing recording. The returning position is located at a first position downstream from the sheet facing area in the first orientation, under a condition that the determined ink amount is less than a threshold value; and the returning position is located at a second position downstream from the first position in the first orientation, under a condition that the determined ink amount is not less than the threshold value.

11 Claims, 11 Drawing Sheets

(51) Int. Cl.

| | |
|---|---|
| ***B41J 2/165*** | (2006.01) |
| ***B41J 23/02*** | (2006.01) |
| ***B41J 29/02*** | (2006.01) |
| ***B41J 29/13*** | (2006.01) |
| ***B41J 29/38*** | (2006.01) |
| *B41J 2/17* | (2006.01) |

(52) U.S. Cl.
CPC ..... *B41J 2/16526* (2013.01); *B41J 23/025* (2013.01); *B41J 29/02* (2013.01); *B41J 29/13* (2013.01); *B41J 29/38* (2013.01); *B41J 2/1707* (2013.01); *B41J 2002/16573* (2013.01)

(58) Field of Classification Search
CPC ..... B41J 2/04596; B41J 2/04533; B41J 2/04541; B41J 2/04573; B41J 2/04581; B41J 2/04555; B41J 2/04595; B41J 2/14225; B41J 2/14217; B41J 25/001; B41J 29/13; B41J 29/02; B41J 23/025
See application file for complete search history.

(56) References Cited

U.S. PATENT DOCUMENTS

| | | | |
|---|---|---|---|
| 2009/0267985 | A1 | 10/2009 | Usui |
| 2016/0144613 | A1 | 5/2016 | Fukazawa |

* cited by examiner

INK-JET PRINTER

CROSS REFERENCE TO RELATED APPLICATION

The present application is a continuation of U.S. patent application Ser. No. 15/696,449, filed Sep. 6, 2017, which further claims priority from Japanese Patent Application No. 2016-175448 filed on Sep. 8, 2016, the disclosures of both of which are incorporated herein by reference in their entirety.

BACKGROUND

Field of the Invention

The present invention relates to an ink-jet printer configured to record an image, etc. on a sheet.

Description of the Related Art

In a conventional printer, a flushing processing for causing an ink to be jetted (discharged) from respective nozzles for the purpose of discharging a dried ink inside the nozzles, etc., is executed before executing recording of an image on a sheet. For example, there is a well-known technique for making an amount of the ink, to be jetted in the flushing processing, to be greater as a time elapsed since the ink has been jetted immediately therebefore is longer. Further, there is also a well-known technique for executing the flushing processing while causing a carriage to be moved.

SUMMARY

In the recent years, an attempt is made, in an information processing apparatus and a printer which are connected to each other via a communication network, to shorten FPOT (abbreviation of First Print Out Time) that is a time since a print instruction or command is input to the information processing apparatus (terminal) until a first sheet is discharged from the printer. Further, as one of the methods for shortening the FPOT, it is considered to shorten the time for a preparing processing such as the flushing processing, etc.

Conventionally, however, the amount of ink to be jetted in the flushing processing is increased or decreased depending on the state of the printer. Further, in a case that the amount of the ink to be jetted in the flushing processing becomes great, the preparation processing requires time and thus the FPOT is lowered. On the other hand, in a case that the amount of the ink jetted in the flushing processing is insufficient, the quality of image recording is lowered.

The present teaching has been made in view of the above-described situation, and an object of the present teaching is to provide an ink-jet printer capable of shortening the FPOT while maintaining the quality of image recording.

According to an aspect of the present teaching, there is provided an ink-jet printer including: a conveyer configured to convey a sheet in a conveyance direction; a recording head including a plurality of nozzles; a carriage having the recording head mounted thereon and configured to reciprocate in a scanning direction which crosses the conveyance direction; an ink receiver arranged at a position downstream from a sheet facing area in a first orientation of the scanning direction, the sheet facing area facing the sheet conveyed by the conveyer; and a controller. The controller is configured to control the conveyer, the recording head and the carriage to execute: receiving a recording instruction for recording an image on a sheet; in response to receipt of the recording instruction, determining an ink amount of the ink which is to be jetted from the plurality of nozzles before the image is recorded on the sheet; moving the carriage in the first orientation of the scanning direction up to a returning position corresponding to the determined ink amount; moving the carriage in a second orientation of the scanning direction, which is opposite to the first orientation, from the returning position up to the sheet facing area; executing a flushing processing for causing the ink, in the determined ink amount, to be jetted from the plurality of nozzles toward the ink receiver in a process in which the carriage is being moved in the second orientation of the scanning direction from the returning position up to the sheet facing area; and executing recording of the image by causing the ink to be jetted from the plurality of nozzles toward the sheet, conveyed by the conveyer, after the carriage has reached the sheet facing area. The returning position is located at a first position downstream from the sheet facing area in the first orientation of the scanning direction, under a condition that the determined ink amount is less than a threshold value, and the returning position is located at a second position downstream from the first position in the first orientation of the scanning direction, under a condition that the determined ink amount is not less than the threshold value.

According to the above configuration, in a case that the ink amount to be jetted in the flushing processing is great, the returning position becomes distanced away from the sheet facing area. For this reason, in a case that the carriage is moved upstream in the scanning direction from the returning position up to the sheet facing area, the moving distance across which the carriage is moved becomes long. As a result, in the flushing processing executed while moving the carriage, the ink can be jetted in a required ink amount in the ensured manner, thereby making it possible to maintain the quality of image recording in the recording processing.

On the other hand, as the ink amount to be jetted in the flushing processing is smaller, the returning position becomes nearer or closer to the sheet facing area. For this reason, the time for executing the moving of the carriage in the first orientation up to the returning position corresponding to the determined ink amount, and the time for executing the moving of the carriage upstream in the scanning direction from the returning position up to the sheet facing area are shortened. Further, in this case, even if the moving distance across which the carriage is moved so as to reach the sheet facing area is short, the ink can be jetted in the required ink amount. As a result, it is possible to shorten the FPOT while maintaining the quality of image recording.

As described above, the moving distance across which the carriage is moved in the flushing processing is increased or decreased, depending on the ink amount of the ink to be jetted. Thus, is it possible to shorten the FPOT while maintaining the quality of image recording.

BRIEF DESCRIPTION OF THE DRAWINGS

FIGS. 5A, 5B and 5C are each a view schematically depicting the configuration of a switching mechanism 170, wherein FIG. 5A depicts a first state, FIG. 5B depicts a second state, and FIG. 5C depicts a third state of the switching mechanism 170.

DESCRIPTION OF THE EMBODIMENTS

Figure 1:
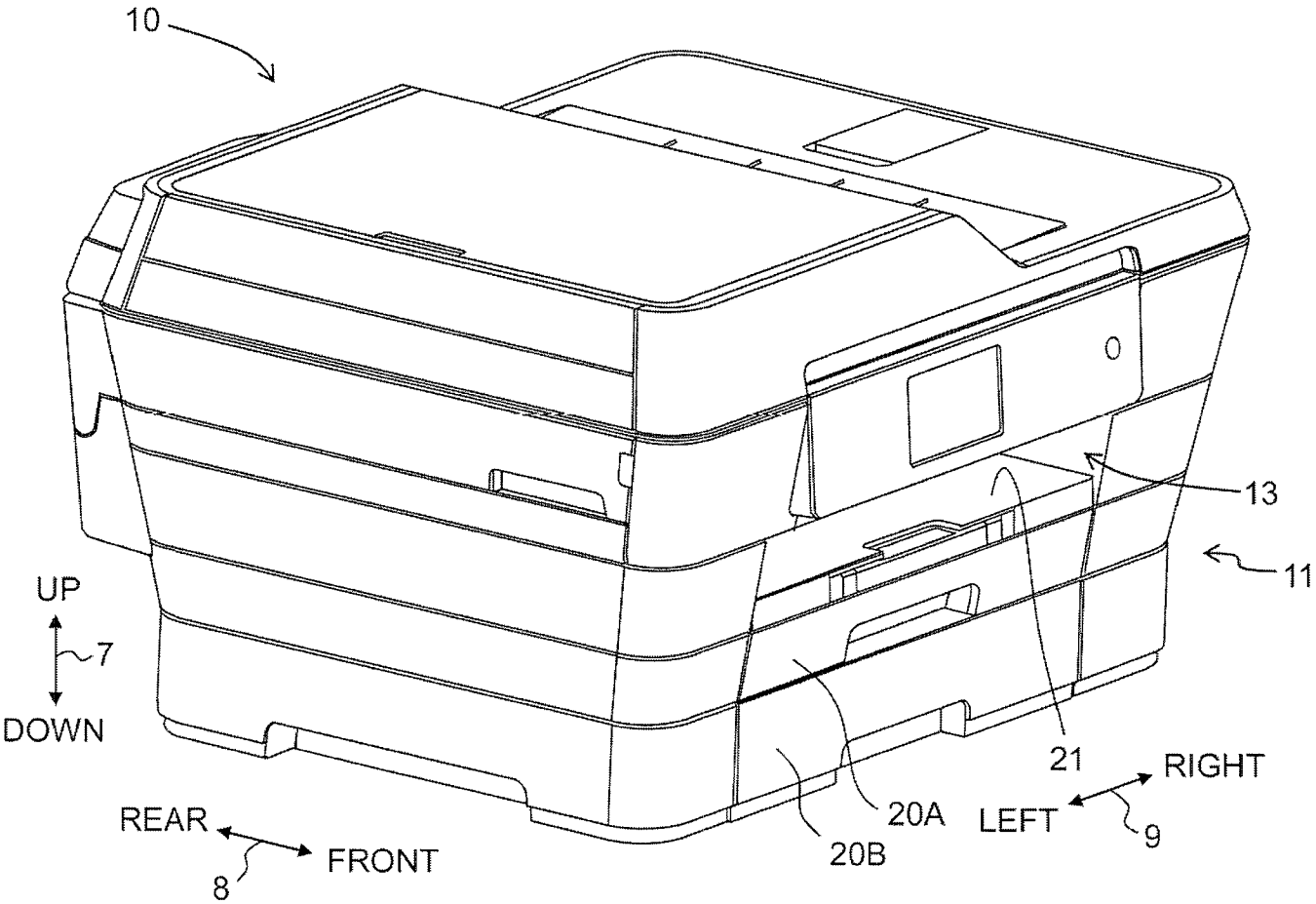
FIG. 1 is a perspective view depicting the outer appearance of a multi-function peripheral 10.

In the following, an embodiment of the present teaching will be described, with reference to the drawings. Note that, however, the embodiment described below is merely an example of the present teaching; it goes without saying that it is possible to make any appropriate change(s) in the embodiment of the present teaching without departing from the gist and/or scope of the present teaching. Further, in the following explanation, an up/down direction 7 is defined with a state in which a multi-function peripheral 10 is usably installed (a usable state; a state depicted in FIG. 1), as the reference; a front/rear direction 8 is defined, with a side on which an opening 13 of the multi-function peripheral 10 is provided is designated as the frontward side (front surface or front side); and a left/right direction 9 is defined as viewing the multi-function peripheral 10 from the frontward side (front surface).

<Overall Configuration of Multi-Function Peripheral 10>

As depicted in FIG. 1, the multi-function peripheral 10 is formed to have a substantially rectangular parallelepiped shape. The multi-function peripheral 10 includes a printer 11. The multi-function peripheral 10 is an example of an ink-jet printer. Further, the multi-function peripheral 10 may further include, for example, a scanner which is configured to read an original (manuscript) and to generate an image data of an image in the original; etc.

<Printer 11>

Figure 2:
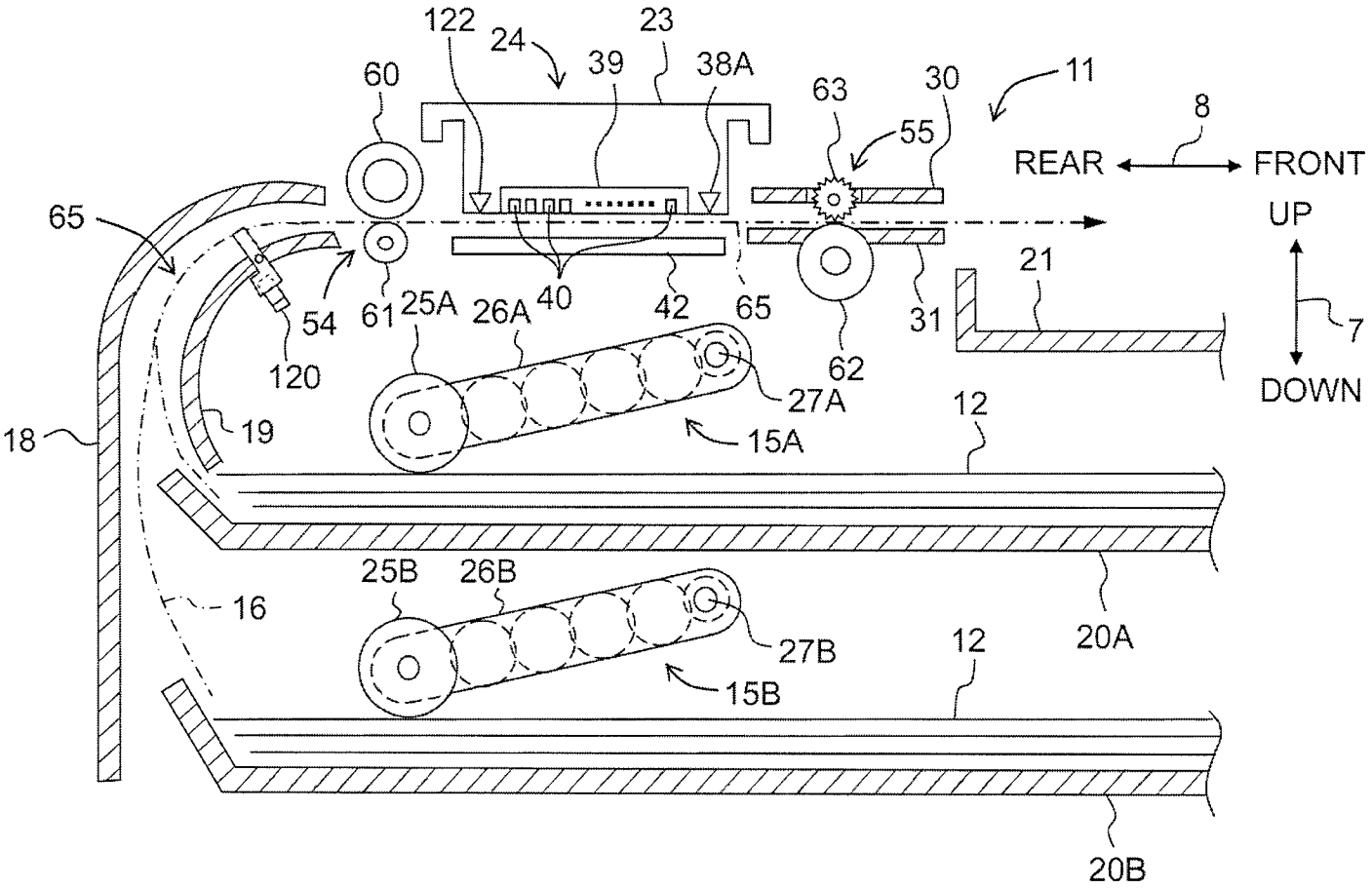
FIG. 2 is a vertical cross-sectional view schematically depicting the internal structure of a printer 11.

The printer 11 records an image, indicated by the image data, on a sheet 12 (see FIG. 2) by jetting (discharging) an ink onto the sheet 12. The printer 11 adopts a so-called ink-jet recording system. As depicted in FIG. 2, the printer 11 is provided with feeding sections 15A and 15B, feed trays 20A and 20B, a discharge tray 21, a conveyance roller section 54, a recording section 24, a discharge roller section 55, and a platen 42. The conveyance roller section 54 and the discharge roller section 55 are an example of a conveyer.

<Feed Trays 20A and 20B, Discharge Tray 21>

The opening 13 (see FIG. 1) is formed in the front surface of the printer 11. The feed trays 20A and 20B are inserted into or removed from the printer 11 in the front/rear direction 8 through the opening 13. The feed trays 20A and 20B each support a plurality of pieces of the sheet 12 that are stacked in the feed tray 20A, 20B. The discharge tray 21 supports the sheet 12 discharged by the discharge roller section 55 via the opening 13.

<Feeding Sections 15A and 15B>

As depicted in FIG. 2, the feeding section 15A includes a feeding roller 25A, a feeding arm 26A, and a shaft 27A. The feeding roller 25A is rotatably supported by the feeding arm 26A at a front end thereof. The feeding arm 26A is pivotably supported by the shaft 27A supported by a frame of the printer 11. The feeding arm 26A is urged toward the feeding tray 20A by a bias which is applied thereto by an elastic force of a spring or by the self-weight of the feeding arm 26A such that the feeding arm 26A is pivoted toward the feed tray 20A. The feeding section 15B includes a feeding roller 25B, a feeding arm 26B, and a shaft 27B. Since the specific construction of the feeding section 15B is common with that of the feeding section 15A, the explanation therefor will be omitted. The feeding section 15A feeds, with the feeding roller 25A, a sheet 12 supported by the feed tray 20A to a conveyance route 65. The feeding roller 25A is rotated by a driving force generated by the rotation of a feeding motor 101 (see FIG. 6) in a normal direction and transmitted to the feeding roller 25A. The feeding section 15B feeds, with the feeding roller 25B, a sheet 12 supported by the feed tray 20B to the conveyance route 65. The feeding roller 25B is rotated by a driving force generated by the rotation of the feeding motor 101 in the normal direction and transmitted to the feeding roller 25B.

<Conveyance Route 65>

The conveyance route 65 is defined by guide members 18 and 30 and guide members 19 and 31. The guide member 18 and the guide member 19 face with each other with a predetermined interval or gap intervened therebetween and the guide member 30 and the guide member 31 face with each other with a predetermined interval intervened therebetween, in the interior of the printer 11. The conveyance route 65 is a route or path which extends from rear-end portions of the feed trays 20A and 20B toward the rear side of the printer 11. Further, the conveyance route 65 makes a U-turn frontwardly while extending from the lower side to the upper side, at the rear side of the printer 11; and then the conveyance route 65 reaches the discharge tray 21 via the recording section 24. Note that a conveyance direction 16 in which the sheet 12 is conveyed inside the conveyance route 65 is indicated by an arrow of a dot-dash chain line in FIG. 2.

<Conveyance Roller Section 54>

The conveyance roller section 54 is arranged on the upstream side from the recording section 24 in the conveyance direction 16 (arranged upstream from the recording section 24 in the conveyance direction 16). The conveyance roller section 54 includes a conveyance roller 60 and a pinch roller 61 which are facing each other. The conveyance roller 60 is driven by a conveyance motor 102 (see FIG. 6). The pinch roller 61 rotates following the rotation of the conveyance roller 60. The sheet 12 is conveyed in the conveyance direction 16 by being pinched between the conveyance roller 60 and the pinch roller 61. In this situation, the conveyance roller 60 is rotated in the normal direction (rotated normally or positively) by being transmitted with a driving force generated by the rotation of the conveyance motor 102 in the normal direction, and conveys the sheet 12 in the conveyance direction 16. The conveyance roller 60 rotates in a reverse direction, which is reverse to that of the normal direction of the normal rotation, by being transmitted with a driving force generated by the rotation the conveyance motor 102 in the reverse direction.

<Discharge Roller Section 55>

The discharge roller section 55 is arranged downstream from the recording section 24 in the conveyance direction 16. The discharge roller section 55 includes a discharge roller 62 and a spur 63 which are facing each other. The discharge roller 62 is driven by the conveyance motor 102. The spur 63 rotates following the rotation of the discharge roller 62. The sheet 12 is conveyed in the conveyance direction 16 by being pinched between the discharge roller 62 and the spur 63. In this situation, the discharge roller 62 is rotated in the normal direction by being transmitted with the driving force generated by the rotation of the conveyance motor 102 in the normal direction.

<Registration Sensor 120>

As depicted in FIG. 2, the printer 11 is provided with a registration sensor 120. The registration sensor 120 is arranged upstream from the conveyance roller section 54 in the conveyance direction 16. The registration sensor 120 outputs different detection signals, depending on whether or not the sheet 12 is present at a setting position. Under a condition that the sheet 12 is present at the setting position, the registration sensor 120 outputs a HIGH level signal to a controller 130 (to be described later on; see FIG. 6). On the other hand, under a condition that the sheet 12 is not present at the setting position, the registration sensor 120 outputs a LOW level signal to controller 130.

<Rotary Encoder 121>

Figure 6:
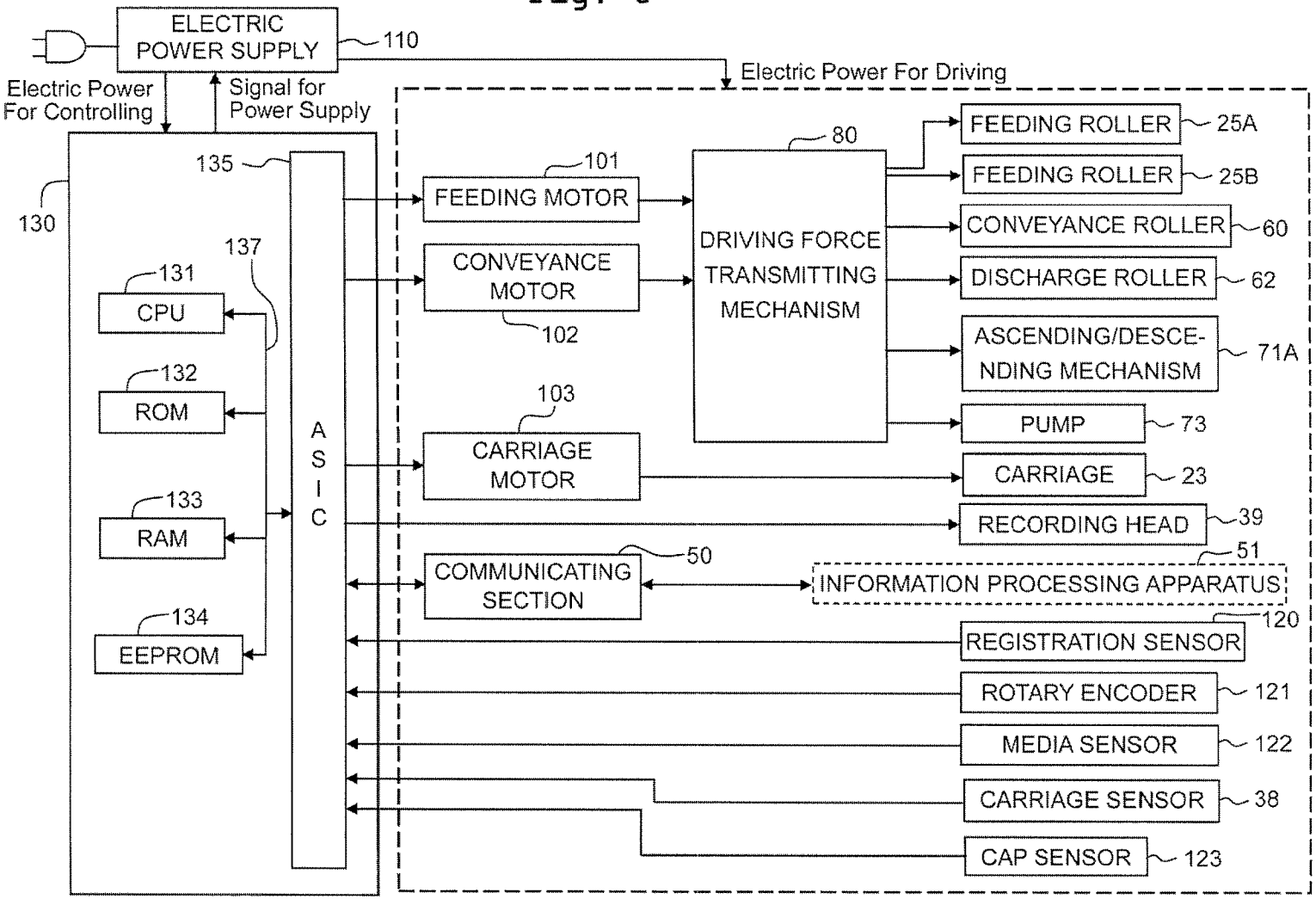
FIG. 6 is a block diagram of the multi-function peripheral 10.
Figure 7:
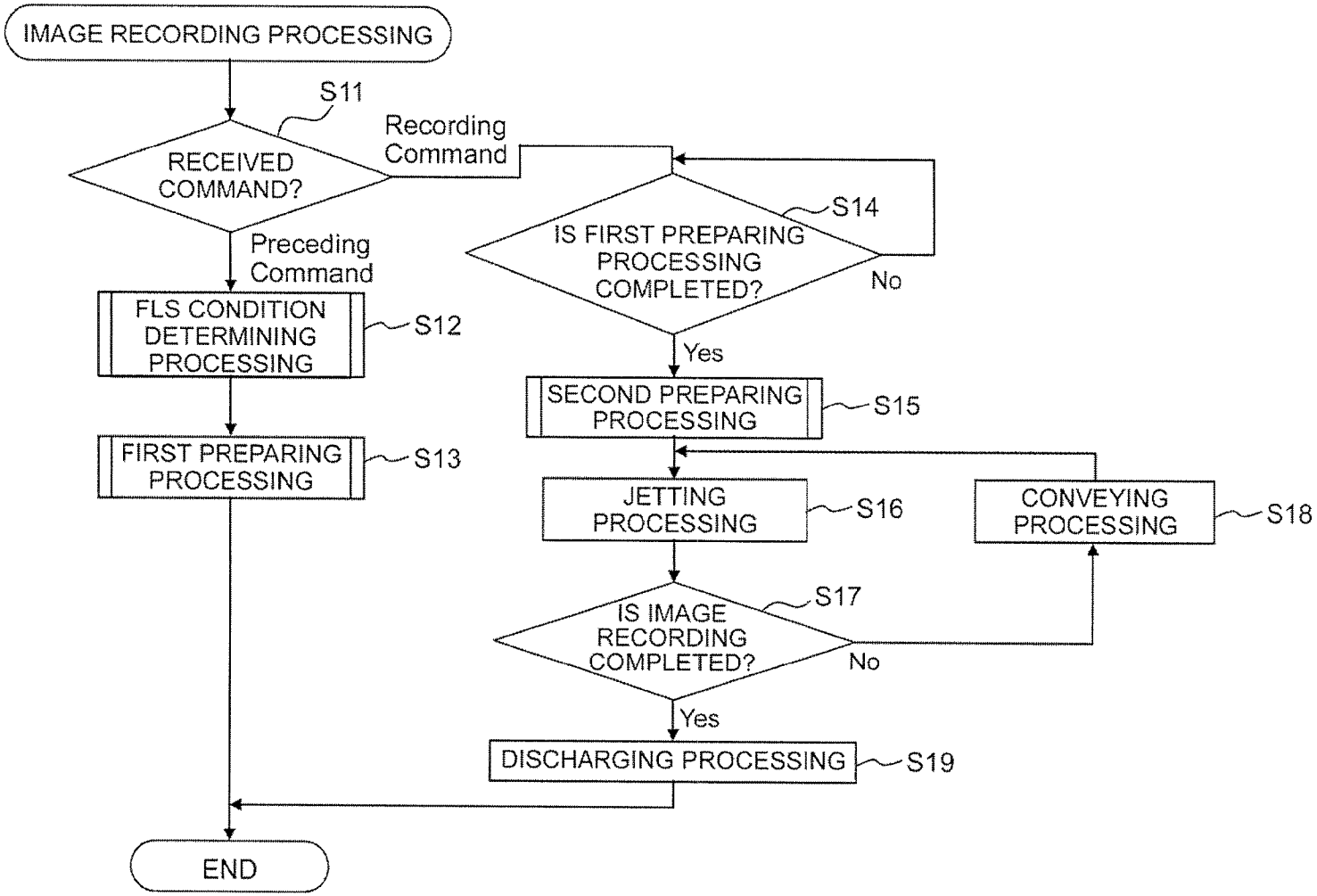
FIG. 7 is a flow chart of an image recording processing.
Figure 8:
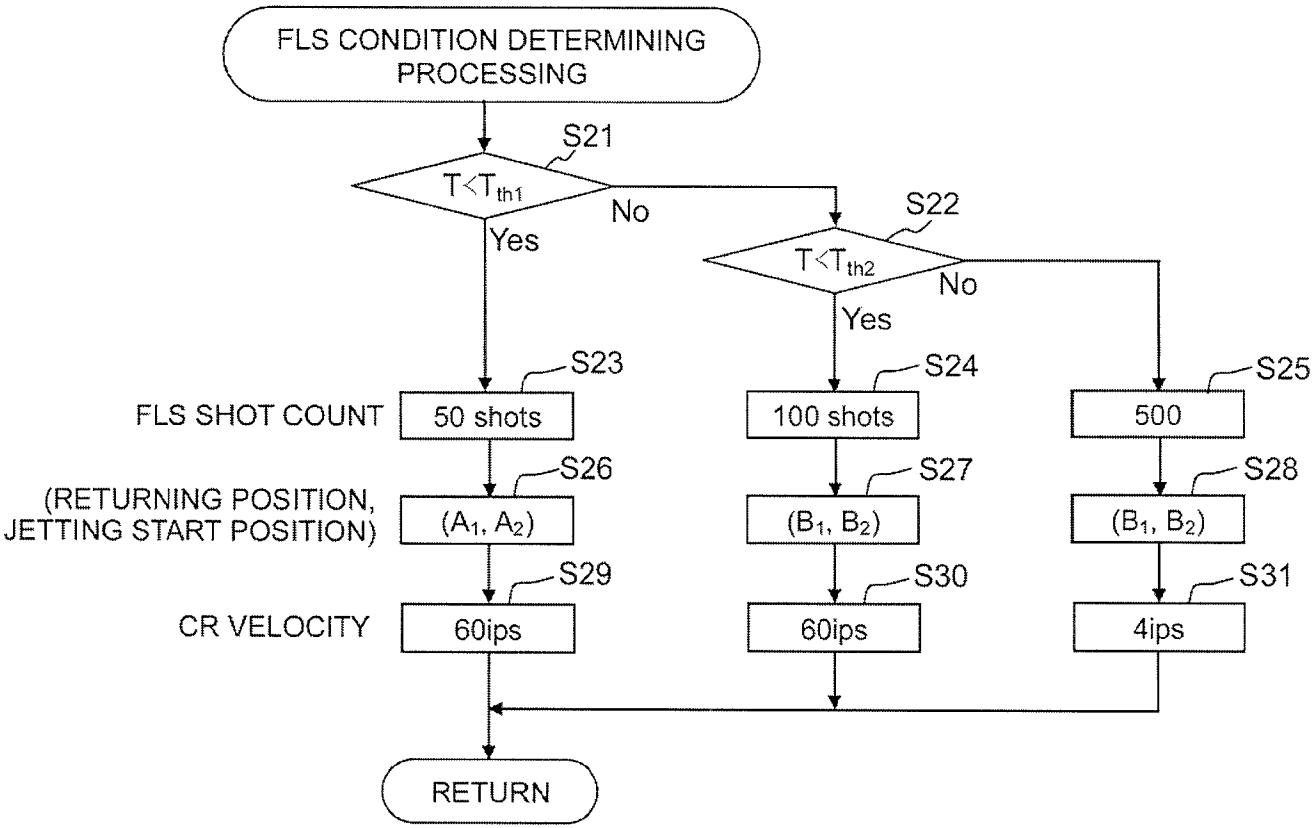
FIG. 8 is a flow chart of a FLS condition determining processing.

As depicted in FIG. 6, the printer 11 is provided with a rotary encoder 121 which is configured to generate a pulse signal depending on the rotation of the conveyance roller 60 (in other words, the rotary driving of the conveyance motor 102). The rotary encoder 121 is provided with an encoder disc and an optical sensor. The encoder disc rotates together with the rotation of the conveyance roller 60. The optical sensor reads the rotating encoder disc so as to generate a pulse signal, and outputs the generated pulse signal to the controller 130.

<Recording Section 24>

Figure 3:
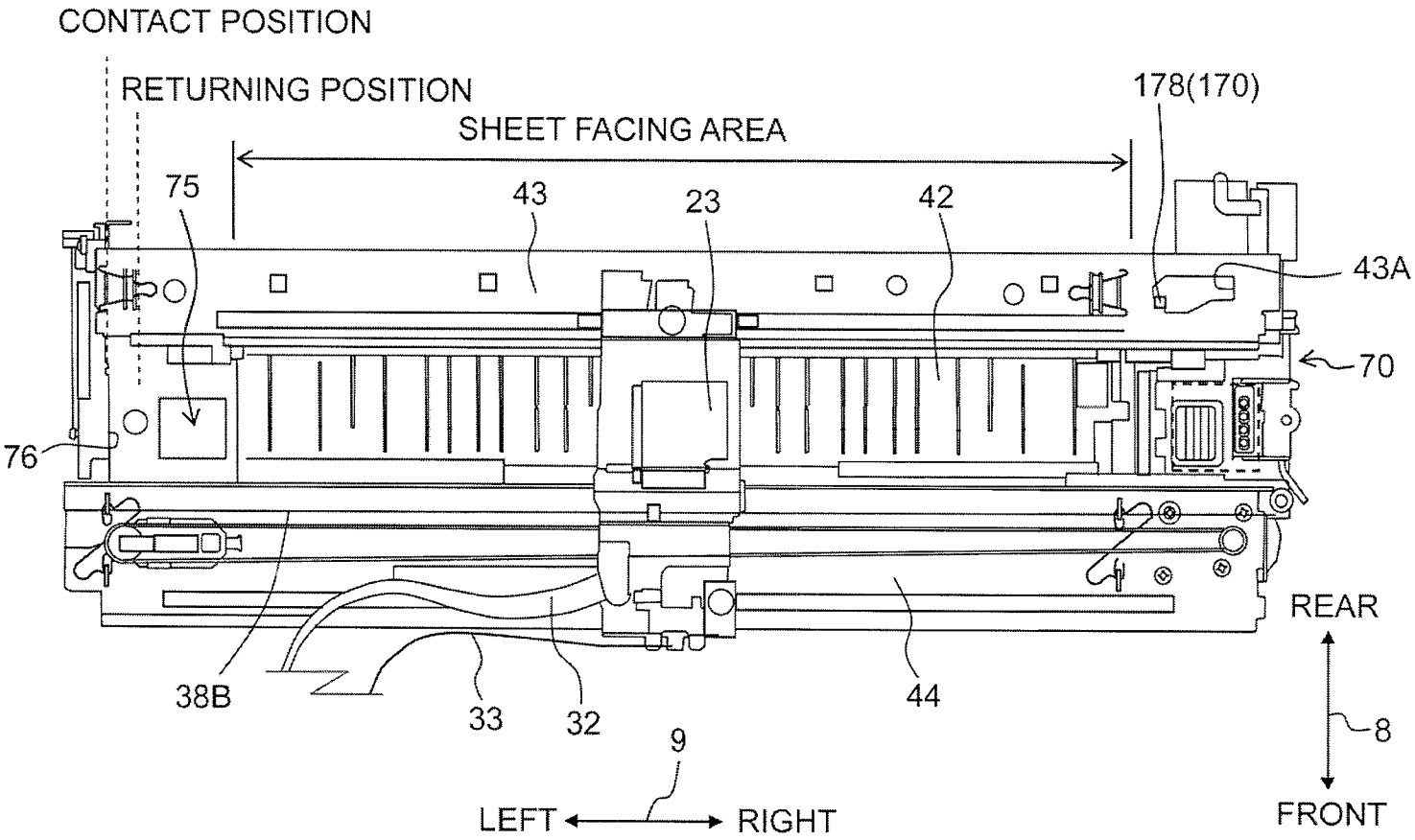
FIG. 3 is a plane view of a carriage 23 and guide rails 43 and 44.

As depicted in FIG. 2, the recording section 24 is arranged between the conveyance roller section 54 and the discharge roller section 55 in the conveyance direction 16. Further, the recording section 24 is arranged to face the platen 42 in the up/down direction 7. Furthermore, the recording section 24 includes a carriage 23, a recording head 39, an encoder sensor 38A and a media sensor 122. Further, as depicted in FIG. 3, an ink tube 32 and a flexible flat cable 33 are connected to the carriage 23. An ink in an ink cartridge is supplied to the recording head 39 via the ink tube 32. The flexible flat cable 33 electrically connects the recording head 39 to a control circuit board having the controller 130 mounted thereon.

As depicted in FIG. 3, the carriage 23 is supported by guide rails 43 and 44 which are extended respectively in the left/right direction 9, at positions separated respectively in the front/rear direction 8. The carriage 23 is connected to a known belt mechanism disposed on the guide rail 44. Note that the belt mechanism is driven by a carriage motor 103 (see FIG. 6). Namely, the carriage 23, connected to the belt mechanism which circumferentially moves by being driven by the carriage motor 103, is capable of reciprocating in the left/right direction 9 in an area including a sheet facing area.

The sheet facing area means an area in the main scanning direction in which an object such as the carriage 23 may face a sheet 12 conveyed by the conveyer. In other words, the sheet facing area means an area which is included in a space located above the sheet conveyed onto the platen 42 by the conveyer and in which the carriage 23 may pass therethrough. Further, the carriage 23 is capable of moving in the left/right direction 9 between an area located on the left side from the sheet facing area and another area located on the right side from the sheet facing area. The left/right direction 9 is an example of a scanning direction (a main scanning direction). The left direction in the left/right direction 9 is an example of the first orientation of the scanning direction, and the right direction in the left/right direction 9 is an example of the second orientation of the scanning direction.

As depicted in FIG. 2, the recording head 39 is installed or mounted on the carriage 23. A plurality of nozzles 40 is arranged in the lower surface of the recording head 39 (in the following description, the lower surface of the recording head 39 will be referred to as a "nozzle surface"). In the recording head 39, a vibrating element such as a piezoelectric element is vibrated to thereby jet or discharge an ink droplet of an ink through each of the nozzles 40. In a process during which the carriage 23 is moved, the recording head 39 jets the ink droplets toward the sheet 12 supported by the platen 42. Accordingly, an image, etc. is recorded on the sheet 12.

The vibrating element is an example of a jetting energy-generating element which generates, from driving voltage applied by an electric power supply 110 (see FIG. 6), an energy for causing the ink droplet to be jetted from the nozzle 40 (namely, the vibrational energy). Note that, however, the specific example of the jetting-energy generating element is not limited to the vibrational element, and may be, for example, a heater which generates thermal energy. Further, the heater may heat the ink by thermal energy generated from a driving voltage applied by the electrical power supply 110, and may cause an ink droplet, which is foamed by being heated, to be jetted from the nozzle. Furthermore, although the recording head 39 according to the present embodiment jets a pigment ink, the recording head 30 may jet a dye ink.

Moreover, the recording head 39 may jet, for example, a main droplet and a satellite droplet of an ink from the nozzle 40. The main droplet and the satellite droplet are, for example, such droplets which are separate ink droplets at a stage at which the main and satellite droplets are jetted from the nozzle 40, which are joined in the air and land on a substantially same position in the sheet, and which form one dot on the sheet. In the present specification, the unit of the ink forming one dot on the sheet is expressed as "one droplet" or "one shot". Namely, in "FLS shot count" which will be described later, a main droplet and a satellite droplet which land on a substantially same position on a sheet are collectively or inclusively counted as one shot.

The plurality of nozzles 40 are arranged in rows in the front/rear direction 8 and the left/right direction 9, as depicted in FIGS. 2 and 4. The nozzles 40 arranged to form a row in the front/rear direction 8 (hereinafter referred to as a "nozzle row") jet ink droplets of a same color. The nozzle surface is formed with 24 nozzle rows which are arranged in the left/right direction 9. Further, every six adjacent nozzle rows, among the 24 nozzle rows, jet ink droplets of a same color ink. In the present embodiment, among the 24 nozzle rows, six nozzle rows from the right end jet ink droplets of a black ink, another six nozzle row adjacent to the six nozzle rows jet ink droplets of a yellow ink, yet another six nozzle rows adjacent to the another six nozzle rows jet ink droplets of a cyan ink, and still yet another six nozzle rows from the left end jet ink droplets of a magenta ink. Note that, however, the combination of the number of the nozzle row and the colors of inks to be jetted are not limited to the above-described examples.

Further, an encoder strip 38B, which has a band-shape and which extends in the left/right direction 9, is arranged on the guide rail 44, as depicted in FIG. 3. The encoder sensor 38A is mounted on the lower surface of the carriage 23 at a position at which the encoder sensor 38A faces the encoder strip 38B. In a process in which the carriage 23 is moved, the encoder sensor 38A reads the encoder strip 38B to thereby generate a pulse signal, and outputs the generated pulse signal to the controller 130. The encoder sensor 38A and the encoder strip 38B construct a carriage sensor 38 (see FIG. 6).

<Media Sensor 122>

As depicted in FIG. 2, the media sensor 122 is mounted on the carriage 23 at the lower surface (surface facing the platen 42) of the carriage 23. The media sensor 122 is provided with a light emitting section including a light-emitting element such as a light emitting diode, etc., and a light receiving section including a light-receiving element such as an optical sensor, etc. The light emitting section irradiates a light at a light amount instructed by the controller 130 toward the platen 42. The light irradiated from the light emitting section is reflected by the platen 42 or a sheet 12 supported by the platen 42, and the reflected light is received by the light receiving section. The media sensor 122 outputs, to the controller 130, a detection signal depending on a light receiving amount in the light receiving section. For example, as the light receiving amount is greater, the media sensor 122 outputs a detection signal of higher level to the controller 130.

<Platen 42>

As depicted in FIG. 2, the platen 42 is arranged between the conveyance roller section 54 and the discharge roller section 55 in the conveyance direction 16. The platen 42 is arranged so as to face the recording section 24 in the up/down direction 7. The plane 42 supports the sheet 12, conveyed by at least one of the conveyance roller section 54 and the discharge roller section 55, from therebelow. The light reflectance of the platen 42 in the present embodiment is set to be lower than that of the sheet 12.

<Maintenance Mechanism 70>

As depicted in FIG. 3, the printer 11 is further provided with a maintenance mechanism 70. The maintenance mechanism 70 is configured to perform maintenance for the recording head 39. More specifically, the maintenance mechanism 70 executes a purge operation of sucking an ink, air, etc. inside the nozzles 40, and any foreign matter or substance adhered to the nozzle surface. In the following explanation, the ink, air, etc., inside the nozzles 40 and any foreign matter or substance adhered to the nozzle surface are referred to as the "ink, etc.". The ink, etc., sucked and removed by the maintenance mechanism 70 are stored in a waste liquid tank 74 (see FIG. 4A). As depicted in FIG. 3, the maintenance mechanism 70 is arranged at a location which is on the right of the sheet facing area (namely, on the downstream from the sheet facing area in the second orientation) and which is below the sheet facing area. The maintenance mechanism 70 is provided with a cap 71, a tube 72 and a pump 73, as depicted in FIG. 4A.

The cap 71 is constructed of a rubber. In a case that the carriage 23 is located at a maintenance position on the right side relative to the sheet facing area, the cap 71 is located at a position at which the cap 71 faces the recording head 39 mounted on the carriage 23. The tube 72 reaches the waste liquid tank 74 from the cap 71 and via the pump 73. The pump 73 is, for example, a tube pump of a rotary system. The pump 73 is driven by the conveyance motor 102 to thereby suck the ink, etc., inside the nozzles 40 via the cap 71 and the tube 72, and to discharge the sucked ink, etc., to the waste liquid tank 74 via the tube 72.

The cap 71 is constructed, for example, to be movable between a covering position and a separate position which are separate and away in the up/down direction 7. The cap 71 located at the covering position makes tight contact with the recording head 39 mounted on the carriage 23 which is located at the maintenance position, and covers the nozzle surface. On the other hand, the cap 71 located at the separate position is separated and away from the nozzle surface. The cap 71 is movable between the covering position and the separate position by an ascending/descending mechanism 71A (an elevator 71A) (see FIG. 6) which is driven by the feeding motor 101. Note that, however, the specific configuration for moving the cap 71 closer relative to the recording head and for separating the cap 71 relative to the recording head 39 is not limited to the above-described example.

As another example, it is allowable that the cap 71 is moved by a non-illustrated link mechanism which operates accompanying with the movement of the carriage 23, instead of being moved by the ascending/descending mechanism driven by the feeding motor 101. The posture of the link mechanism is changeable from a first posture in which the link mechanism holds the cap 71 at the covering position, and a second posture in which the link mechanism holds the cap 71 at the separate position. For example, the link mechanism is contacted by the carriage 23 moving rightwardly toward the maintenance position and thus the posture of the link mechanism is changed from the second posture into the first posture. On the other hand, for example, the link mechanism is contacted by the carriage 23 moving leftwardly from the maintenance position and thus the posture of the link mechanism is changed from the first posture into the second posture.

As still another example, it is allowable that the multi-function peripheral 10 is provided with an ascending/descending mechanism which moves the guide rails 43 and 44 in the up/down direction 7, instead of the mechanism which moves the cap 71. Namely, the carriage 23 at the maintenance position is ascended/descended together with the guide rails 43 and 44 which are ascended/descended by the ascending/descending mechanism. On the other hand, the cap 71 is fixed to a position at which the cap 71 faces the recording head 39 mounted on the carriage 23 which is located at the maintenance position. Further, the guide rails 43 and 44 and the carriage 23 are lowered or descended to a predetermined position by the ascending/descending mechanism, thereby allowing the nozzle surface of the recording head 39 to be covered by the cap 71. On the other hand, the guide rails 43 and 44 and the carriage 23 are lifted or ascended to another predetermined position by the ascending/descending mechanism, thereby allowing the recording head 39 and the cap 71 to be separated away from each other, and allowing the carriage 23 to be movable in the main scanning direction.

As yet another example, it is allowable that the multi-function peripheral 10 is provided with both the ascending/descending mechanism which moves the cap 71 and the ascending/descending mechanism which moves the guide rails 43 and 44. Further, it is allowable that the carriage 23 and the cap 71 are moved in directions, respectively, such that the carriage 23 and the cap 71 approach closely to each other, thereby bringing the cap 71 into a tight contact with the nozzle surface. Furthermore, it is allowable that the carriage 23 and the cap 71 are moved in directions, respectively, such that the carriage 23 and the cap 71 are separated away from each other, thereby allowing the cap 71 to be separated away from the nozzle surface. Namely, the above-described covering position and separate position are a relative position of the cap 71 relative to the recording head 39. Further, by moving one or both of the recording head 39 and the cap 71, the relative position of the cap 71 relative to the recording head 39 may be changed. In other words, by moving the recording head 39 and the cap 71 relative to each other, the relative position of the cap 71 relative to the recording head 39 may be changed.

<Cap Sensor 123>

As depicted in FIG. 6, the printer 11 is further provided with a cap sensor 123. The cap sensor 123 outputs different detection signals, depending on whether or not the cap 71 is located at the covering position. Under a condition that the cap 71 is located at the covering position, the cap sensor 123 outputs a HIGH level signal to the controller 130. On the other hand, under a condition that the cap 71 is located at a position different from the covering position, the cap sensor 123 outputs a LOW level signal to controller 130. Note that in a case that the cap 71 is moved from the covering position to the separate position, the detection signal outputted from the cap sensor 123 changes from the HIGH level signal to the LOW level signal before the cap 71 reaches the separate position.

<Ink Receiving Section 75>

As depicted in FIG. 3, the printer 11 is further provided with an ink receiving section 75. The ink receiving section 75 is arranged at a location which is on the left side relative to the sheet facing area (namely, arranged on the downstream side from the sheet facing area in the first orientation) and which is below the sheet facing area. More specifically, in a case that the carriage 23 is located on the left side relative to the sheet facing area, the ink receiving section 75 is arranged at a position at which the ink receiving section 75 faces the lower surface of the recording head 39 mounted on the carriage 23. Note that it is allowable that the maintenance mechanism 70 and the ink receiving section 75 are arranged on a same side in the main scanning direction, with the sheet facing area as the reference. Note that, however, the maintenance mechanism 70 and the ink receiving section 75 are arranged at positions which are separate and away from each other in the main scanning direction.

Figure 4B:
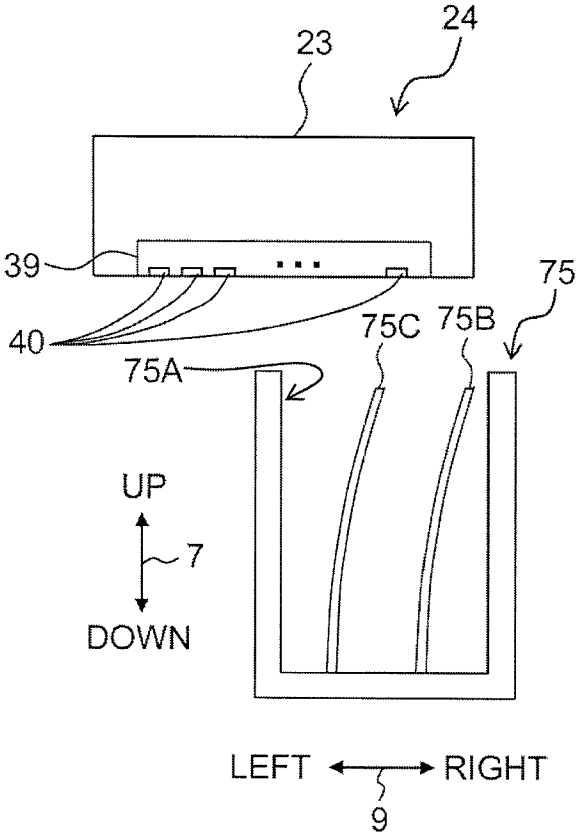
FIG. 4B is a view schematically depicting the configuration of an ink receiving section 75.
Figure 4A:
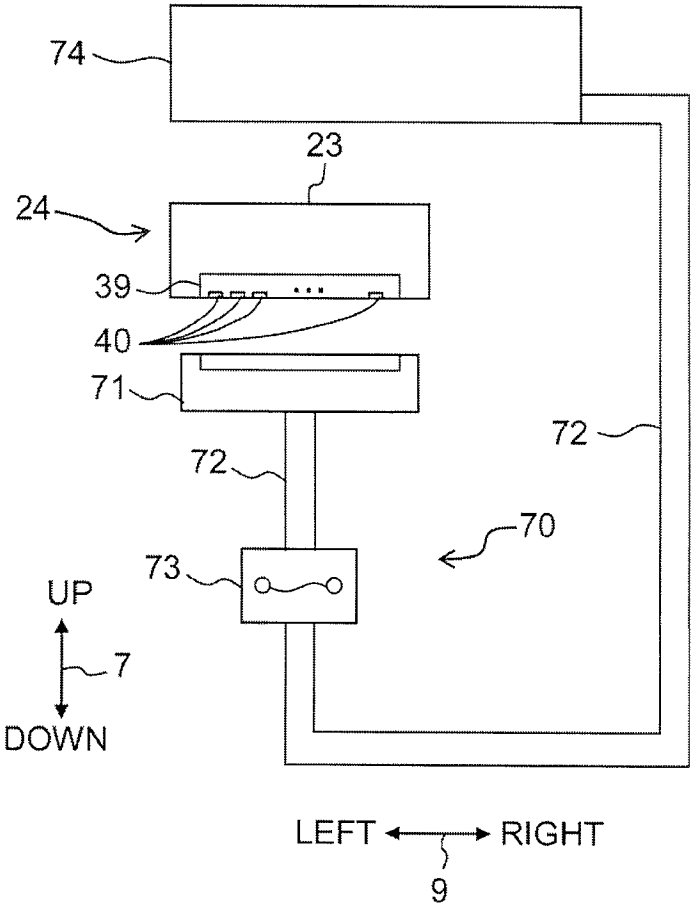
FIG. 4A is a view schematically depicting the configuration of a maintenance mechanism 70.

As depicted in FIG. 4B, the ink receiving section 75 has a box-shape which is substantially rectangular parallelepiped and which has an opening 75A formed in the upper surface thereof. The width in the main scanning direction of the opening 75A is shorter than the width in the main scanning direction of the nozzle surface. Further, guide walls 75B and 75C each of which crosses the main scanning direction are arranged inside the ink receiving section 75, at positions apart in the left/right direction 9, respectively.

The guide walls 75B and 75C are each a plate-shaped member spreading in the up/down direction 7 and the front/rear direction 8. Further, the guide walls 75B and 75C are disposed such that each of the guide walls 75B and 75C is inclined in the left/right direction 9. More specifically, the guide walls 75B and 75C are arranged inside the ink receiving section 75 such that the left surface of each of the guide walls 75B and 75C faces (is oriented) in a left obliquely upward direction. Each of the guide walls 75B and 75C guides an ink droplet, which is jetted from the recording head 39, toward the interior or innermost surface (bottom surface) of the ink receiving section 75. Note that, however, the number of the guide walls 75B, 75C is not limited to 2 (two).

<Left End Wall 76>

As depicted in FIG. 3, a left end wall 76 is disposed on the left end in the main scanning direction of an area in which the carriage 23 is movable. Namely, in a case that the carriage 23 is located at the left end in the main scanning direction, the left end wall 76 makes contact with the carriage 23. The left end wall 76 is, for example, a portion or part of the frame of the printer 11. The position of the carriage 23 when the carriage 23 makes contact with the left end wall 76 is an example of the contact position, and the left end wall 76 is an example of a contact portion. The contact position is a position farther on the left side (namely, on the downstream in the first orientation) with respect to positions $A_1$ and $B_1$ (to be described later on). In other words, the left end wall 76 regulates the movement of the carriage 23 leftward beyond the contact position.

<Driving Force Transmitting Mechanism 80>

As depicted in FIG. 6, the printer 11 is further provided with a driving force transmitting mechanism 80. The driving force transmitting mechanism 80 is configured to transmit the driving forces generated by the feeding motor 101 and the conveyance motor 102 to the feeding rollers 25A, 25B, the conveyance roller 60, the discharge roller 62, the ascending/descending mechanism for the cap 71 and the pump 73. The driving force transmitting mechanism 80 is constructed by combining all or a part of: a gear, a pulley, an endless annular belt, a planetary gear mechanism (pendulum gear mechanism), a one-way clutch, and the like. Further, the driving force transmitting mechanism 80 is provided with a switching mechanism 170 (see FIG. 5) configured to change a transmittance destination to which the driving forces generated by the feeding motor 101 and the conveyance motor 102 are transmitted.

<Switching Mechanism 170>

As depicted in FIG. 3, the switching mechanism 170 is arranged on the right side from (relative to) the sheet facing area. Further, the switching mechanism 170 is arranged to a location below the guide rail 43. As depicted in FIG. 5, the switching mechanism 170 is provided with a sliding member 171, driving gears 172 and 173, gears 174, 175, 176 and 177 each meshing with the driving gear 172 or 173, a lever 178 and springs 179 and 180 each of which is provided as an example of an urging member. The switching mechanism 170 is configured such that the state thereof is switchable to a first state, a second state and a third state.

The first state is such a state that the driving force of the feeding motor 101 is transmitted to the feeding roller 25A, but not transmitted to the feeding roller 25B and the ascending/descending mechanism for the cap 71. The second state is such a state that the driving force of the feeding motor 101 is transmitted to the feeding roller 25B, but not transmitted to the feeding roller 25A and the ascending/descending mechanism for the cap 71. The third state is such a state that the driving force of the feeding motor 101 is transmitted to the ascending/descending mechanism for the cap 71, but not transmitted to the feeding roller 25A and the feeding roller 25B. Further, each of the first state and the second state is also such a state that the driving force of the conveyance motor 102 is transmitted to the conveyance roller 60 and the discharge roller 62, but not transmitted to the pump 73. The third state is also such a state that the driving force of the conveyance motor 102 is transmitted to all of the conveyance roller 60, the discharge roller 62, and the pump 73.

The sliding member 171 is a substantially columnar-shaped member which is supported by a supporting shaft (indicated in broken lines in FIG. 5) extending in the left/right direction 9. Further, the sliding member 171 is configured to be slidable in the left/right direction 9 along the supporting shaft. Furthermore, the sliding member 171 supports the driving gears 172 and 173 such that the driving gears 172 and 173 are rotatable independently from each other at locations, on the outer circumferential surface of the sliding member 171, which are shifted or separated from each other in the left/right direction 9. Namely, the sliding member 171 and the driving gears 172 and 173 make a sliding movement in the left/right direction 9 integrally.

Figure 5A:
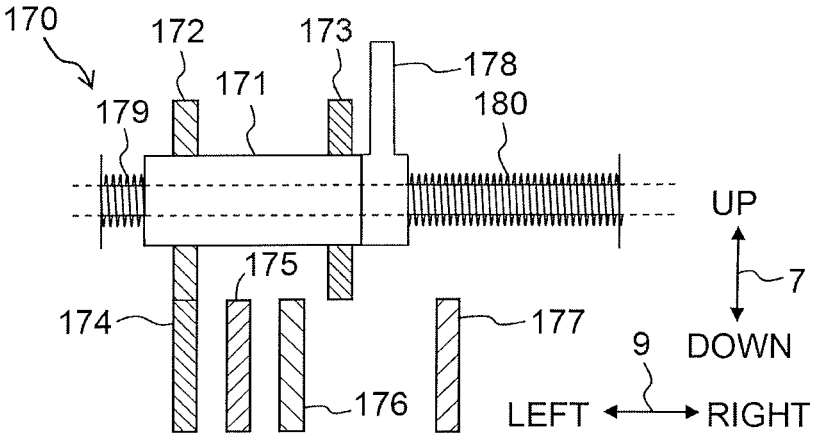
Figure 5B:
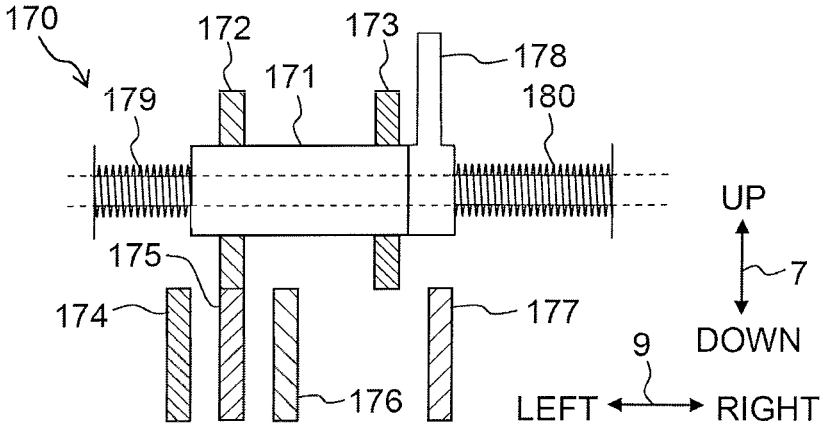
Figure 5C:
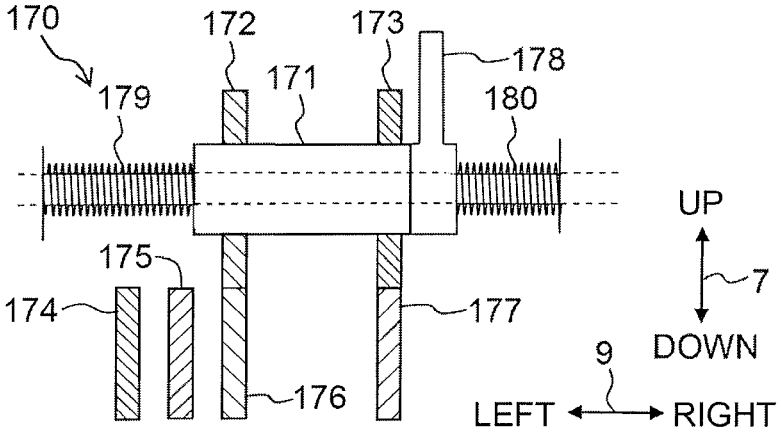

The driving gear 172 is rotated by the rotary driving force transmitted from the feeding motor 101 to the driving gear 172. The driving gear 172 meshes with one of the gears 174, 175 and 176. More specifically, in a case that the switching mechanism 170 is in the first state, the driving gear 172 meshes with the gear 174, as depicted in FIG. 5A. Further, in a case that the switching mechanism 170 is in the second state, the driving gear 172 meshes with the gear 175, as depicted in FIG. 5B. Furthermore, in a case that the switching mechanism 170 is in the third state, the driving gear 172 meshes with the gear 176, as depicted in FIG. 5C.

The driving gear 173 is rotated by the rotary driving force transmitted from the conveyance motor 102 to the driving gear 173. In a case that the state of the switching mechanism 170 is either one of the first state and the second state, the meshing of the driving gear 173 with the gear 177 is released, as depicted in FIGS. 5A and 5B. Further, in a case that the state of the switching mechanism 170 is the third state, the driving gear 173 meshes with the gear 177, as depicted in FIG. 5C.

The gear 174 meshes with a gear train rotating the feeding roller 25A. Namely, the rotary driving force of the feeding motor 101 is transmitted to the feeding roller 25A by the meshing of the driving gear 172 with the gear 174. Further, the rotary driving force of the feeding motor 101 is not transmitted to the feeding roller 25A due to the release of meshing of the driving gear 172 with the gear 174.

The gear 175 meshes with a gear train rotating the feeding roller 25B. Namely, the rotary driving force of the feeding motor 101 is transmitted to the feeding roller 25B by the meshing of the driving gear 172 with the gear 175. Further, the rotary driving force of the feeding motor 101 is not transmitted to the feeding roller 25B due to the release of meshing of the driving gear 172 with the gear 175.

The gear 176 meshes with a gear train driving the ascending/descending mechanism for the cap 71. Namely, the rotary driving force of the feeding motor 101 is transmitted to the ascending/descending mechanism 71A for the cap 71 by the meshing of the driving gear 172 with the gear 176. Further, the rotary driving force of the feeding motor 101 is not transmitted to the ascending/descending mechanism 71A for the cap 71 due to the release of meshing of the driving gear 172 with the gear 176.

The gear 177 meshes with a gear train driving the pump 73. Namely, the rotary driving force of the conveyance motor 102 is transmitted to the pump 73 by the meshing of the driving gear 173 with the gear 177. Further, the rotary driving force of the conveyance motor 102 is not transmitted to the pump 73 due to the release of meshing of the driving gear 173 with the gear 177. On the other hand, the rotary driving force of the conveyance motor 102 is transmitted to the conveyance roller 60 and the discharge roller 62 not via the switching mechanism 170. Namely, the conveyance roller 60 and the discharge roller 62 are rotated by the rotary driving force transmitted thereto from the conveyance motor 102, regardless of the state of the switching mechanism 170.

The lever 178 is supported by the supporting shaft at a location adjacent to a right side portion of the sliding member 171. Further, the lever 178 is configured to be slidable in the left/right direction 9 along the supporting shaft. Furthermore, the lever 178 is projected upwardly. Moreover, a forward end (tip portion) of the lever 178 reaches up to a position at which the forward end is capable of contacting with the carriage 23, via an opening 43A (see FIG. 3) formed in the guide rail 43. The lever 178 is configured to be slidable in the left/right direction 9 by being contacted by the carriage 23 and by being separated from the carriage 23. Further, the switching mechanism 170 is provided with a plurality of locking sections configured to lock the lever 178. Accordingly, the lever 178, in a state of being locked by a locking section among the plurality of locking sections and being separated from the carriage 23 at a certain location, may remain at the certain location even after the lever 178 has been separated away from the carriage 23.

The springs 179 and 180 are supported by the supporting shaft. The spring 179 makes contact with the frame of the printer 11 at one end (left end) of the spring 179, and the spring 179 makes contact with the left end surface of the sliding member 171 at the other end (right end) of the spring 179. Namely, the spring 179 urges the sliding member 171 and the lever 178 contacting the sliding member 171 rightwardly. The spring 180 makes contact with the frame of the printer 11 at one end (right end) of the spring 180, and the spring 180 makes contact with the right end surface of the lever 178 at the other end (left end) of the spring 180. Namely, the spring 180 urges the lever 178 and the sliding member 171 contacting the lever 178 leftwardly. Further, the urging force of the spring 180 is greater than the urging force of the spring 179.

In a case that the lever 178 is locked by a first locking section included in the plurality of locking sections, the switching mechanism 170 is in the first state. Then, the lever 178, pushed or pressed by the carriage 23 moving rightwardly, moves rightwardly against the urging force of the spring 180, and is locked by a second locking section located on the right side with respect to the first locking section. With this, the sliding member 171 moves rightwardly, by the urging force of the spring 179, following the movement of the lever 178. As a result, the state of the switching mechanism 170 is changed from the first state depicted in FIG. 5A to the second state depicted in FIG. 5B. Namely, the lever 178 is contacted by the carriage 23 which is moving rightwardly toward the maintenance position to thereby switch the state of the switching mechanism 170 from the first state into the second state.

Further, the lever 178, pressed by the carriage 23 moving rightwardly toward the maintenance position, moves rightwardly against the urging force of the spring 180, and is locked by a third locking section located farther on the right side with respect to the second locking section. With this, the sliding member 171 moves rightwardly, by the urging force of the spring 179, following the movement of the lever 178. As a result, the state of the switching mechanism 170 is changed from the first state depicted in FIG. 5A or the second state depicted in FIG. 5B to the third state depicted in FIG. 5C. Namely, the lever 178 is contacted by the carriage 23 which is moving rightwardly toward the maintenance position to thereby switch the state of the switching mechanism 170 into the third state.

Furthermore, the lever 178, pressed by the carriage 23 moving farther rightwardly from the maintenance position and then separated away from the carriage 23 moving leftwardly, is released from the locking by the third locking section. With this, the sliding member 171 and the lever 178 are moved leftwardly by the urging force of the spring 180.

Then, the lever 178 is locked by the first locking section. As a result, the state of the switching mechanism 170 is changed from the third state depicted in FIG. 5C to the first state depicted in FIG. 5A. Namely, the lever 178 is separated from the carriage 23 which is moving leftwardly from the maintenance position to thereby switch the state of the switching mechanism 170 from the third state into the first state.

Namely, the state of the switching mechanism 170 is switched by the contact and separation of the carriage 23 with respect to the lever 178. In other words, the transmittance destinations of the driving forces of the feeding motor 101 and the conveyance motor 102 are switched by the carriage 23. Note that the state of the switching mechanism 170 according to the present embodiment is not switched directly from the third state to the second state; rather, the state of the switching mechanism 170 is required to be switched from the third state to the first state, then further switched from the first state to the second state, as described above.

<Electric Power Supply 110>

The multi-function peripheral 10 has the electric power supply 110, as depicted in FIG. 6. The electric power supply 110 supplies the electric power, supplied thereto from an external power supply via a power plug, to the respective constituent components, parts, etc., of the multi-function peripheral 10. More specifically, the electric power supply 110 outputs the electric power obtained from the external power supply as a driving electric power (for example, 24V) to the respective motors 101 to 103 and the recording head 39, and outputs the electric power as a controlling electric power (for example, 5V) to the controller 130.

Further, the electric power supply 110 is capable of being switched (switchable) between a driving state and a sleeping state, based on a power signal outputted from the controller 130. More specifically, the controller 130 outputs a HIGH level power signal (for example, 5V) to thereby switch the electric power supply 110 from the sleeping state to the driving state. On the other hand, the controller 130 outputs a LOW level power signal (for example, 0V) to thereby switch the electric power supply 110 from the driving state to the sleeping state.

The term "driving state" means a state in which the driving electric power is outputted to the motors 101 to 103 and to the recording head 39. In other words, the driving state means a state in which the motors 101 to 103 and the recording head 39 are each in an operable state or an active state. The term "sleeping state" means a state in which the driving electric power is not outputted to the motors 101 to 103 and to the recording head 39. In other words, the sleeping state means a state in which the motors 101 to 103 and the recording head 39 are each in an inoperative state or an inactive state. Although not depicted in the drawings, the electric power supply 110 outputs the controlling electric power to the controller 130 and a communicating section 50 (see FIG. 6), regardless of whether or not the electric power supply 110 is in the driving state or in the sleeping state.

<Controller 130>

As depicted in FIG. 6, the controller 130 is provided with a CPU 131, a ROM 132, a RAM 133, an EEPROM 134 and an ASIC 135 which are connected to one another by an internal bus 137. The ROM 132 stores various programs which are executed by the CPU 131 to thereby control a variety of kinds of operations. The RAM 133 is used as a storage area for temporarily storing a data and/or signal to be used when the CPU 131 executes the program(s), or as a working area for data processing. The EEPROM 134 stores setting information which should be retained even after the power supply of the multi-function peripheral 10 is switched off.

The EEPROM 134 stores time information indicating a time at which the ink has been jetted from the nozzles 40 immediately before or most recently (hereinafter referred to as "immediately before discharging time" or "most recent discharging time"). The immediately before discharging time is, for example, a time at which a flushing processing (to be described later on) has been executed immediately before, or a time at which a recording processing (to be described later on) has been executed immediately before. The controller 130 obtains the time information from a system clock (not depicted in the drawings) at a timing at which the ink is jetted, and causes the EEPROM 134 to store the obtained time information. Further, under a condition that the time information has been already stored in the EEPROM 134, the controller 130 overwrites the time information, which has been already stored, with new time information.

The feeding motor 101, the conveyance motor 102 and the carriage motor 103 are connected to the ASIC 135. The ASIC 135 generates a driving signal for rotating each of the motors, and outputs the generated driving signal to each of the motors. Each of the motors is driven to rotate in the normal direction or in the reverse direction, in accordance with the driving signal from the ASIC 135. Further, the controller 130 applies the driving voltage of the electric power supply 110 to the vibrating elements of the recording head 39 to thereby cause the ink droplets to be jetted or discharged from the nozzles 40.

Further, the communicating section 50 is connected to the ASIC 135. The communicating section 50 is a communicating interface capable of communicating with an information processing apparatus 51. Namely, the controller 130 transmits or sends a variety of kinds of information to the information processing apparatus 51 via the communicating section 50, and receives or accepts a variety of kinds of information from the information processing apparatus 51 via the communicating section 50. The communicating section 50 may be, for example, configured to transmit and receive a radio signal by a communication protocol in accordance with Wi-Fi (trade name by Wi-Fi Alliance), or may be an interface to which a LAN cable or a USB cable is connected. Note that in FIG. 6, the information processing apparatus 51 is surrounded by a frame drawn with a broken line so as to distinguish the information processing apparatus 51 from the constituents of the multi-function peripheral 10.

Further, the registration sensor 120, the rotary encoder 121, the carriage sensor 38, the media sensor 122 and the cap sensor 123 are connected to the ASIC 135. The controller 130 detects the position of the sheet 12 based on the detection signal outputted from the registration sensor 120 and the pulse signal outputted from the rotary encoder 121. Further, the controller 130 detects the position of the carriage 23 based on the pulse signal outputted from the carriage sensor 38. Furthermore, the controller 130 detects the position of the cap 71 based on the detection signal outputted from the cap sensor 123.

Moreover, the controller 130 detects the sheet 12 conveyed by the conveyer based on the detection signal outputted from the media sensor 122. More specifically, the controller 130 compares an amount of change (change amount) in signal level between detection signals, which are temporarily adjacent, with a predetermined threshold value. Further, in response to that the change amount in the signal level becomes to be not less than the threshold value, the controller 130 detects that the forward end or a tip end of the sheet 12 has reached a position at which the forward end faces the media sensor 122 in the up/down direction 7.

<Image Recording Processing>

Next, an explanation will be given about an image recording processing of the present embodiment, with reference to FIGS. 7 to 11. In response to that the multi-function peripheral 10 receives a command from the image processing apparatus 51 via the communicating section 50, the multi-function peripheral 10 starts the image recording processing. The command received from the information processing apparatus 51 is an example of a recording instruction for recording an image on a sheet.

Note that at a time of starting the image recording processing, it is assumed that the carriage 23 is located at the maintenance position, the cap 71 is located at the covering position, and the switching mechanism 170 is in the third state. The respective processing to be described below may be executed such that the CPU 131 reads out the program stored in the ROM 132 and executes the read program, or may be executed by a hardware circuit mounted on the controller 130. Note that the order of execution of the respective processing may be appropriately changed, without departing from the gist and/or scope of the present teaching.

Firstly, although not depicted in the drawings, under a condition for example that the information processing apparatus 51 receives, from a user, a command for causing the multi-peripheral 10 to execute the image recording processing, the information processing apparatus 51 transmits a preceding command to the multi-function peripheral 10. The preceding command is a command previously announcing transmittance of a recording command (to be described later on). Next, under a condition that the information processing apparatus 51 has transmitted the preceding command, the information processing apparatus 51 generates a raster data from an image data designated by the user. Then, under a condition that the information processing apparatus 51 has generated the raster data, the information processing apparatus 51 transmits the recording command to the multi-function peripheral 10. The recording command is a command causing an image indicated by the raster data to be recorded on a sheet.

On the other hand, under a condition that the preceding command has been received from the information processing apparatus 51 via the communicating section 50 (S11: Preceding Command), the controller 130 of the multi-function peripheral 10 executes a FLS condition determining processing (S12). The FLS condition determining processing is a processing for determining an execution condition of a flushing processing. The execution condition of the flushing processing includes, for example, the FLS shot count, the returning position, a jetting start position, and a CR velocity. The FLS condition determining processing will be explained in detail with reference to FIG. 8.

The FLS shot count is the total of ink droplets which are to be jetted from each of the nozzles 40 in the flushing processing. Namely, the FLS shot count is an example of the ink amount of the ink to be jetted from each of the nozzles 40 before the recording processing. The returning position is a target position for the carriage 23 in the first moving processing, and is a movement starting position for the carriage 23 in the second moving processing. The jetting start position is a position of the carriage 23 at a time at which the flushing processing is started. The CR velocity is the maximum value of the moving velocity of the carriage 23 in the flushing processing (in other words, the second moving processing). The specifics of the FLS shot count, the returning position, the jetting start position and the CR velocity will be explained later on.

<FLS Condition Determining Processing>

At first, the controller 130 obtains time information indicating the current time (present time) from the system clock. Then, the controller 130 calculates the difference between the current time and the immediately before jetting time which is stored in the EEPROM 134, as an elapsed time "T" elapsed since the execution of the jetting of the ink immediately before and until the receipt of the preceding command. Further, the controller 130 compares the elapsed time T with threshold times $T_{th1}$ and $T_{th2}$ (S21, S22). The threshold times $T_{th1}$ and $T_{th2}$ are values previously stored in the EEPROM 134, and the threshold time $T_{th1}$ is smaller than the threshold time $T_{th2}$ (namely: Threshold Time $T_{th1}$<Threshold Time $T_{th2}$).

Under a condition that the elapsed time T is less than the threshold time $T_{th1}$ (S21: YES), the controller 130 determines the FLS shot count to be 50 shots (S23). Further, under a condition that the elapsed time T is not less than the threshold time $T_{th1}$ (S21: NO) and is less than the threshold time value $T_{th2}$ (S22: YES), the controller 130 determines the FLS shot count to be 100 shots (S24). Furthermore, under a condition that the elapsed time T is not less than the threshold time value $T_{th2}$ (S22: NO), the controller 130 determines the FLS shot count to be 500 shots (S25). Namely, the FLS shot count becomes great in a case that the elapsed time T is long. The processings of steps S21 to S25 are an example of a determining processing.

Next, under a condition that the FLS shot count has been determined to be 50 shots, the controller 130 determines the returning position to be a position $A_1$, and determines the jetting start position to be a position $A_2$ (S26). Further, under a condition that the FLS shot count has been determined to be 100 shots or 500 shots, the controller 130 determines the returning position to be a position $B_1$, and determines the jetting start position to be a position $B_2$ (S27, S28). The positions $A_1$, $A_2$, $B_1$ and $B_2$ are previously determined within the movement range of the carriage 23. The positions $A_1$, $A_2$, $B_1$ and $B_2$ are specified, for example, by an encoder value (integrated value of the pulse signals) of the carriage sensor 38. The determination that the FLS shot count=100 shots is an example of a threshold value.

Figure 10:
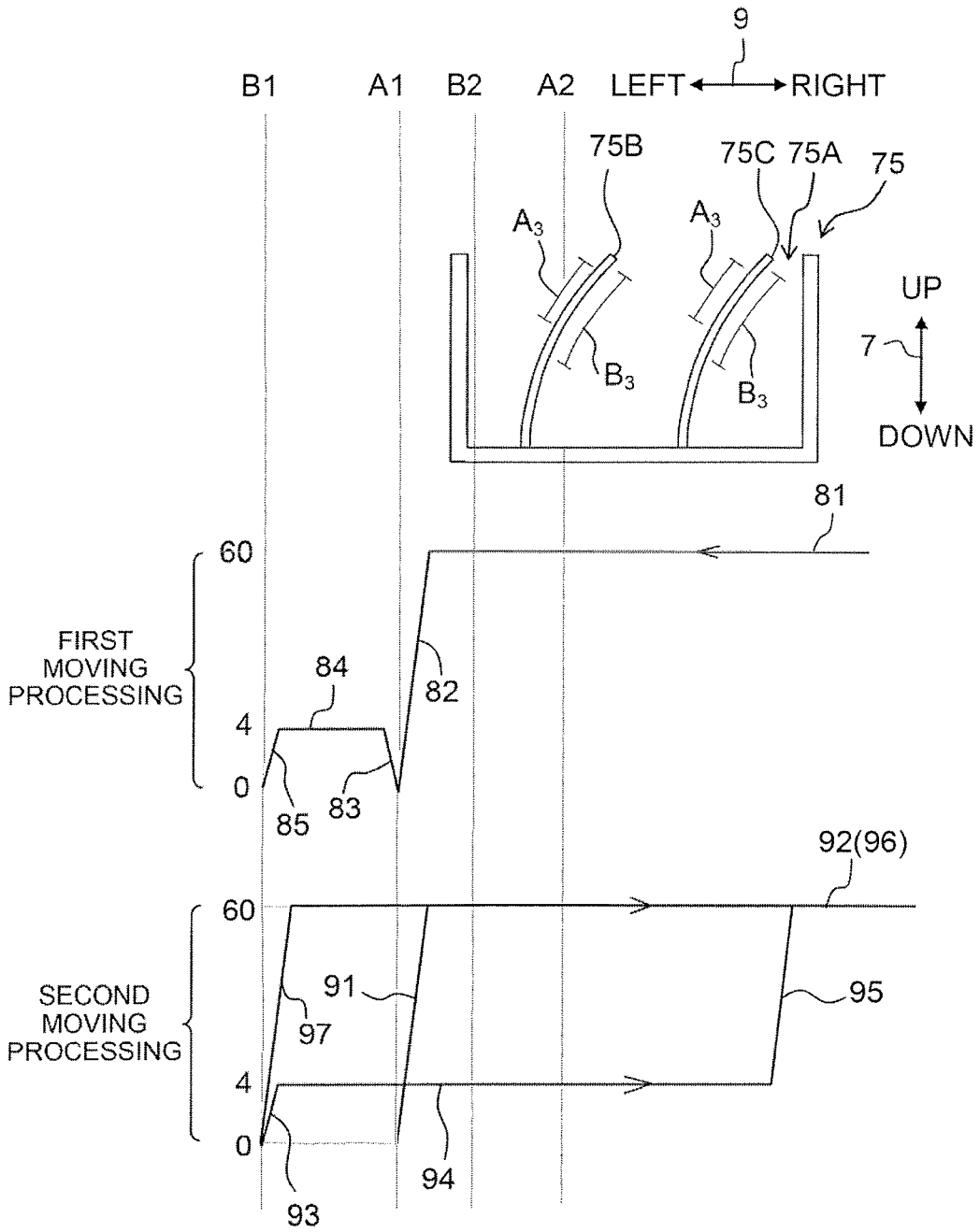
FIG. 10 is a view depicting the relationship between the position and the velocity of the carriage 23 in a first moving processing (S43) and a second moving processing (S51).

The positions $A_1$ and $B_1$ are positions or locations on the left side relative to the sheet facing area. More specifically, the positions $A_1$ and $B_1$ are located at positions, respectively, on the left side relative to the left end of the ink receiving section 75, as depicted in FIG. 10. Note that, however, in a case that the width in the left/right direction 9 of the ink receiving section 75 is great, it is allowable that the positions $A_1$ and $B_1$ are located to be immediately above the ink receiving section 75 (located between the right end and the left end of the ink receiving section 75). Further, the position $B_1$ is located to be on the left side relative to the position $A_1$. Namely, the returning position is located on the left relative to the sheet facing area in a case that the FLS shot count is great. The position $A_1$ is an example of a first position, and the position $B_1$ is an example of a second position.

The positions $A_1$ and $B_2$ are located on the left side relative to the sheet facing area. More specifically, the positions $A_1$ and $B_2$ are located at positions, respectively, on the left side relative to the right end of the ink receiving section 75, as depicted in FIG. 10. Further, the position $A_2$ is located to be on the right side relative to the position $A_1$, and the position $B_2$ is located to be on the right side relative to the position $B_1$. Furthermore, the position $B_2$ is located to be on the left side relative to the position $A_2$. Namely, the jetting start portion is located to be on the left relative to the sheet facing area in a case that the FLS shot count is great. The position $A_2$ is an example of a third position, and the position $B_2$ is an example of a fourth position.

Next, under a condition that the controller 130 determines the FLS shot count to be 50 shot or 100 shots, the controller 130 determines the CR velocity to be 60 ips (S29, S30). On the other hand, under a condition that the controller 130 determines the FLS shot count to be 500 shots, the controller 130 determines the CR velocity to be 4 ips (S31). Namely, the CR velocity is made to be slow in a case that the FLS shot count is great.

Figure 9:
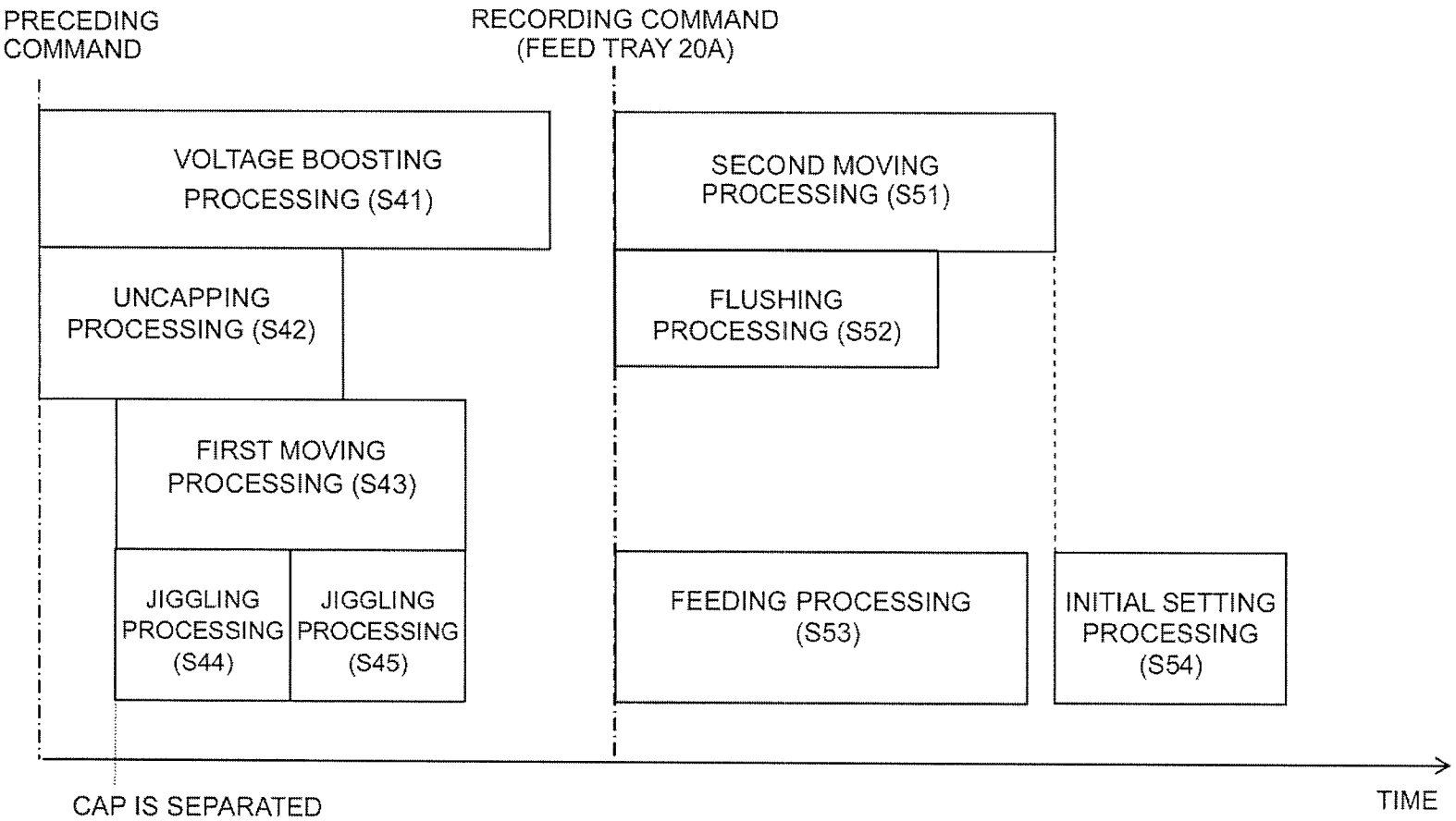
FIG. 9 is a timing chart depicting execution timings for a first preparing processing and a second preparing processing.

Next, returning to FIG. 7, the controller 130 executes a first preparing processing (S13). Namely, the preceding command can be rephrased as a command for instructing the execution of the first preparing processing. The first preparing processing is a processing for allowing the printer 11 to be in a state that the recording processing can be executed. The phrase that "the state that the recording processing can be executed" can be rephrased as, for example, a state that an image can be recorded with a quality of not less than a predetermined level. The first preparing processing includes, for example, a voltage boosting processing (S41), a uncapping processing (S42), a first moving processing (S43), and a jiggling processing (S44, S45), as depicted in FIG. 9.

The voltage boosting processing (S41) is a processing for boosting (raising) the driving voltage, which is (to be) supplied by the electric power supply 110 to the respective elements of the printer 11, up to a FLS voltage $V_F$ (for example, 24V). The electric power supply 110 boosts, for example, the power supply voltage, supplied from the external power supply, up to the FLS voltage $V_F$ with a non-illustrated regulator circuit. Boosting the voltage of the electric power supply 110 means, for example, storing the charge in a power storage element such as a non-illustrated condenser, etc. Further, in a case that the charge corresponding to the FLS voltage $V_F$ has been stored in the power storage element, then the regulator circuit continuously applies the voltage for maintaining the driving voltage to the power storage element.

Note that, however, if the driving voltage is boosted rapidly, there is such a possibility that the driving voltage during the voltage boosting might be unstable. In view of this possibility, for example, the controller 130 boosts the driving voltage up to a check voltage $V_1$ with a feedback control. Next, under a condition that the driving voltage has reached the check voltage $V_1$, the controller 130 raises the driving voltage up to a check voltage $V_2$ with the feedback control. In such a manner, the driving voltage is gradually boosted by repeating a plurality of voltage boosting steps. Namely, $V_1<V_2<\ldots<V_F$ holds. With this, the variation or fluctuation of the driving voltage during the voltage boosting can be suppressed.

Further, in a state that the controller 130 allows the electric power supply 110 to apply the driving voltage to the recording head 39, the controller 130 may execute the voltage boosting processing. The phrase of the "state that (the controller 130 allows the electric power supply 110) to apply the driving voltage to the recording head 39" means, for example, a state that the driving voltage which is being boosted is applied to the vibrating elements of the recording head 39 by allowing a switch element of a circuit from the electric power supply 110 up to the recording head 39 to have a conducted state. In other words, the above state also can be expressed as such a state that in a case that the driving voltage which is being boosted reaches 24V, the ink droplets can be jetted from the nozzles 40. With this, for the reason stated below, the variation in the driving voltage which is being boosted can be suppressed further.

At first, generally, in a case that the voltage applied to a circuit is varied, the raising time and the falling time of the voltage waveform become longer as a resistance component inside the circuit is greater. Namely, as the resistance component is greater, the change in the voltage per unit time is smaller. Further, resistance components such as a transistor constructing the switch element, an output section configured to output the driving signal, etc., are preset in the circuit from the electric power supply 110 up to the vibrating elements of the recording head 39. Accordingly, if provided that the electric power supply 110 up to the recording head 39 is considered as one circuit, it is possible to attenuate the variation in the driving voltage during the voltage boosting, as compared with a case of shutting off the connection between the electric power supply 110 and the recording head 39 to thereby provide the circuit solely for the electric power supply 110 alone.

Further, a control circuit of the recording head 39 having the vibrating elements can be considered as a condenser having a predetermined capacitance. Further, this condenser repeats the charging and discharging accompanying with the variation in the driving voltage applied thereto. As a result, it is possible to remove a high frequency component included in the variation in the voltage, thereby making it possible to further attenuate the variation in the driving voltage during the voltage boosting.

Furthermore, the voltage boosting processing (S41) is executed typically at a timing at which the power is turned ON in the multi-function peripheral 10, or a timing at which the electric power supply 110 is switched from the sleeping state to the driving state. Namely, in a case that the driving voltage supplied from the electric power supply 110 has already reached the FLS voltage $V_F$, the voltage boosting processing (S41) is omitted, in some cases.

The uncapping processing (S42) is a processing for moving the cap 71 from the covering position to the separate position. Namely, the controller 130 rotates the feeding motor 101 just by a predetermined rotational amount. Then, by allowing the rotary driving force of the feeding motor 101 to be transmitted to the ascending/descending mechanism (for the cap 71) via the switching mechanism 170 in the third state, the cap 71 is moved from the covering position to the separate position. Further, the detection signal outputted from the cap sensor 123 is changed from the HIGH level signal to the LOW level signal before the cap 71 reaches the separate position, in other words, during the execution of the uncapping processing.

The first moving processing (S43) includes a processing for switching the state of the switching mechanism 170 from the third state to the first state, and a processing for moving the carriage 23, which has been separated away from the cap 71, to the returning position. Namely, the controller 130 causes the carriage 23 at the maintenance position to move rightwardly, and then to move leftwardly until the carriage 23 reaches the returning position. Further, in order to suppress any destruction of the meniscus of the ink formed in the nozzles 40 of the recording head 39, it is allowable that the controller 130 causes the carriage 23 to move leftwardly at a low speed or velocity at the time at which the processing of step S43 is started, and then the controller 130 executes the processing of step S43.

Note that in the present specification, the phrase that "cause or allow the carriage 23 to move to the target position (for example, the returning position, jetting start position, detection position, maintenance position, etc.)" means allowing or causing any position (for example, the left end position, the arrangement position of the encoder sensor 38A, etc.) of the carriage 23, which has the width in the left/right direction 9, to be coincide with the target position. This is similarly applicable to the expression that "the carriage 23 reaches the target position" or "cause or allow the carriage 23 to reach the target position", as well.

In the first moving processing in which the returning position is the position $A_1$, the controller 130 causes the carriage 23 to be moved leftwardly in a first velocity pattern. As depicted in FIG. 10, the first velocity pattern includes a first acceleration segment (not depicted in the drawings) in which the carriage 23, stopped at the movement starting position (for example, the maintenance position) is accelerated up to 60 ips; a first constant velocity segment 81 in which the carriage 23 is moved at the velocity of 60 ips; and a first deceleration segment 82 in which the carriage 23, being moved at the velocity of 60 ips, is decelerated so as to stop the carriage 23 at the position $A_1$. The maximum velocity of the first velocity pattern is 60 ips which is an example of a first velocity.

On the other hand, in the first moving processing in which the returning position is the position $B_1$, the controller 130 causes the carriage 23 to be moved leftwardly in a second velocity pattern. As depicted in FIG. 10, the second velocity pattern includes the first acceleration segment; the first constant velocity segment 81; the first deceleration segment 82; a second acceleration segment 83 in which the carriage 23, stopped at the position $A_1$, is accelerated up to 4 ips; a second constant velocity segment 84 in which the carriage 23 is moved at the velocity of 4 ips; and a second deceleration segment 85 in which the carriage 23, being moved at the velocity of 4 ips, is decelerated so as to stop the carriage 23 at the position $B_1$. The maximum velocity of the second velocity pattern from the movement starting position up to the position $A_1$ is 60 ips, and the maximum velocity of the second velocity pattern from the position $A_1$ to position $B_1$ is 4 ips which is an example of a second velocity.

Namely, the second velocity pattern up to the position $A_1$ is common with the first velocity pattern. Note that, however, the combination of the maximum velocities in the second velocity pattern is not limited to or restricted by the above-described example. Namely, the maximum velocity of the second velocity pattern may be 60 ips from the movement starting position up to a specific position, and may be 4 ips from the specific position up to the position $B_1$. Namely, the specific position may be same as the position $A_1$, or may be located at a position shifted in the left/right direction 9 relative to the position $A_1$.

Note that, however, the specific position is required to be a position with which the acceleration segment 83, the constant velocity segment 84 and the deceleration segment 85 which are depicted in FIG. 10 can be secured between the specific position and the position $B_1$. More specifically, the specific position is preferably such a position that makes it possible to secure a length, which allows the carriage 23 to move stably at the velocity of 4 ips, in the constant velocity segment 84. Further, the specific position is preferably such a position that makes it possible to secure a length, which allows the carriage 23 to decelerate at a small velocity to such an extent that allows the carriage 23 to stop precisely at the position $B_1$, in the deceleration segment 85.

Further, the second velocity pattern depicted in FIG. 10 causes the carriage 23 to stop once (temporally) at the position $A_1$. It is allowable, however, that the second velocity pattern may include a switching segment in which the moving velocity of the carriage 23 is switched from 60 ips to 4 ips, instead of including the first deceleration segment 82 and the second acceleration segment 83. More specifically, the controller 130 may decelerate the moving velocity from 60 ips to 4 ips in the switching segment between the first constant velocity segment 81 and the second constant velocity segment 84, without stopping the carriage 23.

Although the velocity patterns depicted in FIG. 10 each indicate the relationship between the positions of the carriage 23 and the velocities of the carriage 23 at the positions, respectively, the specific example of the velocity pattern is not limited to those depicted in FIG. 10. For example, the velocity pattern may indicate the relationship between the movement time (movement duration) of the carriage 23 and the movement velocity of the carriage 23. More specifically, it is allowable that the velocity pattern accelerates the carriage 23 up to the velocity of 60 ips in first x seconds, and then moves the carriage at the constant velocity of 60 ips for next y seconds, and stops the carriage 23 in next z seconds. Further, the values of the x, y, z seconds described above may be stored in the EEPROM 134 while being associated with the combination of the movement starting position and a movement ending position of the carriage 23, or may be calculated by the controller 130 such that the carriage 23 is stopped at the movement ending position.

The jiggling processing (S44, S45) is a processing for causing at least one of the feeding motor 101 and the conveyance motor 102 to rotate a little (in a wiggling manner) alternately in the normal and reverse directions. More specifically, under the condition that the switching mechanism 170 is in the third state, the controller 130 causes both of the feeding motor 101 and the conveyance motor 102 to rotate in the wiggling manner alternately in the normal and reverse directions (S44). With this, since the bearing stress between the driving gear 172 and the gear 176 and the bearing stress between the driving gear 173 and the gear 177 are released, the meshings among the respective gears can be released smoothly. Further, in a case that the state of the switching mechanism 170 is changed into the first state, the controller causes the feeding motor 101 to rotate in the wiggling manner alternately in the normal and reverse directions (S45). With this, the driving gear 172 and the gear 174 can be meshed with each other smoothly. Note that the jiggling processing may be only one of steps S44 and S45.

Note that as depicted in FIG. 9, the controller 130 starts the processing of step S41 and the processing of step S42 at the same time at a timing at which the controller 130 receives the preceding command. Namely, the controller 130 executes the processing of step S41 and the processing of step S42 in parallel. Further, the controller 130 starts the processing of step S43 and the processing of step S44 at the same time. Namely, the controller 130 executes the processing of step S43, the processing of step S44 and the processing of step S45 in parallel. Note that, however, the execution timings for the steps S41 to S45, respectively, are not limited to or restricted by the example depicted in FIG. 9.

Further, the controller 130 starts the processing of step S43 at a timing at which the detection signal from the cap sensor 123 is changed from the HIGH level signal to the LOW level signal. Namely, the controller 130 starts the processing of step S43 after starting the processings of steps S41 and S42. More specifically, the controller 130 executes the processing which is included in step S43 and which is for moving the carriage 23 leftwardly at a low velocity and the processing which is included in step S43 and which is for moving the carriage 23 rightwardly from the maintenance position, in parallel with the processing of step S42. On the other hand, the controller 130 executes the processing which is included in the processing of step S43 and which is for moving the carriage 23 leftwardly up to the returning position, after completing the processing of step S42.

Typically, the execution time (duration) of the voltage boosting processing (S41) is the longest among the plurality of processings included in the first preparing processing (S41 to S45). In view of this, the controller 130 executes the processing of step S41 in parallel with the respective processings of step S42 to S45. In other words, the controller 130 executes the processings of steps S42 to S45 at predetermined timings therefor, respectively, while executing the processing of step S41, as depicted in FIG. 9.

Next, returning to FIG. 7, under a condition that the controller 130 receives a recording command from the information processing apparatus 51 via the communicating section 50 (S11: Recording Command), the controller 130 determines whether or not the first preparing processing is completed (S14). Namely, the timing at which the recording command is received is before the completion of the first preparing processing in some cases, as depicted in FIG. 9, or after the completion of the first preparing processing in some cases. Under a condition that the controller 130 determines that the first preparing processing has not been completed yet (S14: NO), the controller 130 holds the execution of the processings, which are to be executed after the first preparing processing, on standby, until the first preparing processing is completed.

Then, under a condition that the controller 130 determines that the first preparing processing has been completed (S14: YES), the controller 130 executes a second preparing processing (S15). The second preparing processing is a processing which is included in the processing for allowing the printer 11 to be in the state that the recording processing can be executed, but which is not included in the first preparing processing. The second preparing processing includes a second moving processing (S51), a flushing processing (S52), a feeding processing (S53) and a positioning processing (cue-feeding processing) (S54), as depicted in FIG. 9.

The second moving processing (S51) is a processing for moving the carriage 23 rightwardly toward a detection position. The term "detection position" means a position which is located at the sheet facing area and at which the carriage 23 is capable of facing a sheet 12 of each of all the sizes (for example, A4, B4, L-size, etc.) supportable by the feed trays 20A and 20B. In a case that the sheet 12 is supported by the feed tray 20A or 20B in a state that the center in the main scanning direction of the sheet 12 is positioned with respect to the feed tray 20A or 20B, the detection position may be located at the center in the main scanning direction of the sheet facing area.

In the second moving processing in a case that the CR velocity is determined to be 60 ips, the controller 130 causes the carriage 23 to be moved rightwardly in a third velocity pattern. As depicted in FIG. 10, the third velocity pattern includes a third acceleration segment 91 in which the carriage 23, stopped at the position $A_1$ is accelerated up to 60 ips; a third constant velocity segment 92 in which the carriage 23 is moved at the velocity of 60 ips; and a third deceleration segment (not depicted in the drawings) in which the carriage 23, being moved at the velocity of 60 ips, is decelerated so as to stop the carriage 23 at the detection position. The maximum velocity of the third velocity pattern is 60 ips which is an example of a third velocity. Further, as depicted in FIG. 10, the third velocity pattern in a case that the CR velocity is determined to be 60 ips (CR velocity=60 ips) in step S30 is common with the above-described example, except that the third acceleration segment 91 is started from the position $B_1$. That is, the third velocity pattern includes a third acceleration segment 97 in which the carriage 23, stopped at the position $B_1$ is accelerated up to 60 ips; the third constant velocity segment 92 in which the carriage 23 is moved at the velocity of 60 ips; and the third deceleration segment (not depicted in the drawings) in which the carriage 23, being moved at the velocity of 60 ips, is decelerated so as to stop the carriage 23 at the detection position.

On the other hand, in the second moving processing in a case that the CR velocity is determined to be 4 ips, the controller 130 causes the carriage 23 to be moved rightwardly in a fourth velocity pattern. As depicted in FIG. 10, the fourth velocity pattern includes a fourth acceleration segment 93 in which the carriage 23, stopped at the position $B_1$, is accelerated up to 4 ips; a fourth constant velocity segment 94 in which the carriage 23 is moved at the velocity of 4 ips; a fifth acceleration segment 95 in which the carriage 23, being moved at the velocity of 4 ips is accelerated up to 60 ips; a fifth constant velocity segment 96 in which the carriage 23 is moved at the velocity of 60 ips; and a fifth deceleration segment (not depicted in the drawings) in which the carriage 23, being moved at the velocity of 60 ips, is decelerated so as to stop the carriage 23 at the detection position.

Note that the fifth acceleration segment 95 of the fourth velocity pattern is started under a condition that the flushing processing is completed. Namely, the maximum velocity of the fourth velocity pattern from the position $B_1$ until the completion of the flushing processing is 4 ips, and the maximum velocity of the fourth velocity pattern after the completion of the flushing processing and up to the detection position is 60 ips which is an example of a fourth velocity. The third velocity pattern and the fourth velocity pattern are common in that the carriage 23 is moved from the returning position up to the detection position, without stopping the carriage 23 at any intermediate position between the returning and detection positions. On the other hand, the fourth velocity pattern is different from the third velocity pattern in that the maximum speed of the fourth velocity pattern is made to be different before and after the completion of the flushing processing.

The flushing processing (S52) is a processing for causing the ink droplets, of which number is the FLS shot count determined in steps S23 to S25, to be jetted from the nozzles 40 toward the ink receiving section 75 in a process in which the carriage 23 is moved in the second moving processing. Note that the flushing processing according to the present embodiment is started in the third constant velocity segment 92 or the fourth constant velocity segment 94. Note that, however, the flushing processing may be started in the third acceleration segment 91 or the fourth acceleration segment 93.

An ink droplet jetting timing at which the ink droplets are jetted in the flushing processing is previously determined such that the ink droplets are allowed to land on areas $A_3$ and $B_3$ of each of the guide walls 75B and 75C. The jetting timing for each of the nozzles 40 is specified, for example, based the encoder value of the carriage sensor 38. In the present embodiment, at an initial timing, ink droplets are jetted from nozzle arrays on the right end and configured to jet the black ink and from nozzle arrays which are adjacent to the nozzle arrays, on the right end and configured to jet the black ink, and which are configured to jet the yellow ink; and then at a next timing, ink droplets are jetted from two groups of nozzle arrays located to be immediate left of the nozzle arrays from which the ink droplets of the black ink and the yellow inks have been jetted at the first timing. Namely, the controller 130 causes the ink droplets from each of the nozzles 40 in the nozzle arrangement order in the main scanning direction (namely, in an order from right to left).

More specifically, the flushing processing in a case that the returning portion is the position $A_1$ is started at a timing at which the carriage 23 reaches the position $A_2$ determined as the jetting start position. The position $A_2$ is a position corresponding to a timing at which the ink jetted from the nozzles 40 of the carriage 23 moving at the velocity of 60 ips land on the first area $A_3$ of each of the guide walls 75B and 75C. Namely, in the flushing processing in this case, the ink which is firstly jetted lands on a lower end of the first area $A_3$, and the ink which is lastly jetted lands on an upper end of the first area $A_3$.

On the other hand, the flushing processing in a case that the returning portion is the position $B_1$ is started at a timing at which the carriage 23 reaches the position $B_2$ determined as the jetting start position. The position $B_2$ is a position corresponding to a timing at which the ink jetted from the nozzles 40 of the carriage 23 which is moving land on the second area $B_3$ of each of the guide walls 75B and 75C. In the flushing processing in a case that the carriage 23 is moved at the velocity of 60 ips, the ink which is firstly jetted lands on a lower end of the second area $B_3$, and the ink which is lastly jetted lands on an upper end of the second area $B_3$. On the other hand, in the flushing processing in a case that the carriage 23 is moved at the velocity of 4 ips, the ink jetted firstly lands on a lower end of the second area $B_3$, and the ink jetted lastly lands on a location below the upper end of the second area $B_3$.

The second area $B_3$ corresponds at least to the first area $A_3$ being extended downwardly. Alternatively, the second area $B_3$ may correspond to the first area $A_3$ being extended upwardly. Namely, the second area $B_3$ also may be an area encompassing the first area $A_3$ in the up/down direction 7. Further, in the flushing processing in which the returning position is the position the controller 130 causes the ink to be jetted from the nozzles 40 at such a timing that the jetted ink lands on the first area $A_3$. On the other hand, in the flushing processing in which the returning position is the position $B_1$, the controller 130 causes the ink to be jetted from the nozzles 40 at a such timing that the jetted ink lands on the second area $B_3$.

Note that before the controller 130 executes the flushing processing, the controller 130 may further execute a non-jetting flushing processing. The term "non-jetting flushing processing" means a processing for vibrating the vibrating elements to such an extent that any ink droplets are not jetted from the nozzles 40. The non-jetting flushing processing may be executed at any timing after the completion of the voltage boosting processing. Namely, the non-jetting flushing processing may be started before a recording command is received. Further, the execution time (duration) of the non-jetting flushing processing may be made grate as, for example, in a case that the elapsed time T is long. With this, the ink droplets are allowed to be easily jetted from the nozzles 40 in the flushing processing.

The feeding processing (S53) is a processing for causing the feeding section 15A to feed a sheet 12, supported by the feed tray 20A, up to a position at which the sheet 12 reaches the conveyance roller section 54. This feeding processing is executed in a case that the recording command indicates the feed tray 20A as the feeding source from where the sheet 12 is fed. The controller 130 causes the feeding motor 101 to rotate normally, and causes the feeding motor 101 to further rotate normally by a predetermined rotation amount after the detection signal of the registration sensor 120 is changed from the LOW level signal to the HIGH level signal. Further, under a condition that the rotary driving force of the feeding motor 101 is transmitted to the feeding roller 25A via the switching mechanism 170 in the first state, the sheet 12 supported by the feed tray 20A is fed to the conveyance route 65.

The initial setting processing (cue-feeding processing) (S54) is a processing for causing the conveyer to convey, in the conveyance direction 16, the sheet 12, which has been conveyed by the feeding processing and has reached the conveyance roller section 54, up to a facing position at which an area, of the sheet 12, in which an image is to be recorded first (hereinafter referred also to as a "recording area" or "initial recording area" in some cases) may face the recording head 39. The initial recording area on the sheet 12 is indicated in the recording command. The controller 130 causes the conveyance motor 102 to rotate normally to thereby cause the conveyer to convey the sheet 12, which has reached the conveyance roller section 54, until the initial recording area indicated by the recording command faces the recording head 39. Further, the controller 130 uses the media sensor 122 to detect the forward end of the sheet 12 during the process in which the initial setting processing is being executed.

Note that the respective processings (S51 to S54) which are included in the second preparing processing cannot be started unless at least a portion of the plurality of processings included in the first preparing processing has been already completed. The second moving processing cannot be started unless the voltage boosting processing, the uncapping processing and the first moving processing have been already completed, but can be started even if the jiggling processing has not been completed yet. On the other hand, the feeding processing cannot be started unless the jiggling processing has been already completed, but can be started even if the voltage boosting processing and the first moving processing have not been completed yet. Further, the flushing processing cannot be started unless the second moving processing has been already started. Furthermore, the initial setting processing cannot be started unless the feeding processing and the second moving processing have been already completed.

Namely, under a condition that the controller 130 receives the recording command and that the voltage boosting processing, the uncapping processing and the first moving processing have been completed (S11: Recording Command & S14: YES), the controller 130 starts the second moving processing. Then, after the controller 130 has started the second moving processing, the controller 130 starts the flushing processing. Namely, the controller 130 executes the second moving processing in parallel with the flushing processing. Furthermore, under a condition that the controller 130 receives the recording command and that the jiggling processing has been completed (S11: Recording Command & S14: YES), the controller 130 starts the feeding processing. Then, under a condition that the feeding processing and the second moving processing have been completed, the controller 130 starts the initial setting processing.

Further, although not depicted in the drawings, in a case that the recording command indicates the feed tray 20B as the feeding source from where the sheet 12 is fed and under a condition that the flushing processing has been completed, the controller 130 switches the state of the switching mechanism 170 from the first state to the second state. Namely, the controller 130 causes the carriage 23 which is being moved in the second moving processing to further move rightwardly, and causes the lever 178 which has been locked by the first locking section to be locked by the second locking section. Further, under a condition that the switching mechanism 170 has been switched into the second state, the controller 130 causes the carriage 23 to move leftwardly toward the detection position. Then, under the condition that the switching mechanism 170 has been switched into the second state, the controller 130 starts the feeding processing for feeding the sheet 12 supported by the feed tray 20B.

Returning to FIG. 7 again, under a condition that all the processings included in the second preparing processing have been completed, the controller 130 executes the recording processing in accordance with the received recording command (S16 to S19). The recording processing includes, for example, a jetting processing (S16) and a conveying processing (S18) which are executed alternately, and a discharging processing (S19). The jetting processing (S16) is a processing for causing the recording head 39 to jet ink droplets with respect to the recording area of the sheet 12 which is made to face the recording head 39. The conveying processing (S18) is a processing for causing the conveyer to convey the sheet 12 only by an amount corresponding to a predetermined conveyance width along the conveyance direction 16. The discharging processing (S19) is a processing for causing the discharge roller section 55 to discharge the sheet 12, having an image recorded thereon, to the discharge tray 21.

Namely, the controller 130 moves the carriage 23 from one end to the other end of the sheet facing area, and causes the recording head 39 to jet ink droplets at a timing indicated by the recording command (S16). Next, under a condition that there is an image to be recorded on a next recording area (S17: NO), the controller 130 causes the conveyer to convey the sheet 12 up to a position at which the next recording area faces the recording head 39 (S18). Until the controller 130 records image(s) to all the recording areas (S17: NO), the controller 130 executes the processings of steps S16 to S18 repeatedly. Under a condition that the image(s) have been recorded on all the recording areas (S17: YES), the controller 130 causes the discharge roller section 55 to discharge the sheet 12 to the discharge tray 21 (S19).

Although not depicted in the drawings, under a condition that a predetermined time has elapsed since the completion of the recording processing (S16 to S19), the controller 130 moves the carriage 23 to the maintenance position, changes the state of the switching mechanism 170 into the third state, and moves the cap 71 to the covering position. Further, under a condition that a predetermined time has elapsed since the movement of the cap 71 to the covering position, the controller 130 switched the state of the electric power supply 110 from the driving state to the sleeping state.

In the embodiment as described above, as the FLS shot count is greater, the returning position is located farther away from the sheet facing area, and thus the moving distance across which the carriage 23 is moved so as to reach the sheet facing area in the second moving processing becomes longer. As a result, in the flushing processing executed while moving the carriage 23, the ink can be jetted in a required ink amount in the ensured manner, thereby making possible to maintain the quality of image recording in the recording processing. On the other hand, as the FLS shot count is smaller, the returning position is made to be closer to the sheet facing area, and thus the execution times for the first moving processing and the second moving processing, respectively, are shortened. Further, in this case, even if the moving distance across which the carriage 23 is moved so as to reach the sheet facing area is short, the ink can be jetted in a required ink amount. As a result, it is possible to shorten the FPOT while maintaining the quality of image recording.

Furthermore, as the moving velocity of the carriage 23 is faster, the time of executing the first moving processing is shortened. On the other hand, in a case that the carriage 23 is to be stopped, as the moving velocity of the carriage 23 is faster, the difference between the target position for stopping the carriage 23 and a real (actual) position at which the carriage 23 is actually stopped is great. Namely, when comparing the first deceleration segment 82 in which the velocity of the carriage 23 is decelerated from the velocity of 60 ips to 0 ips, and the second deceleration segment 85 in which the velocity of the carriage 23 is decelerated from the velocity of 4 ips to 0 ips, the stopping accuracy (precision) in the first deceleration segment 85 is lower than that in the second deceleration segment 85.

Accordingly, in a case of moving the carriage 23, in the first velocity pattern, up to the second position which is close to the contact position, there is such a possibility that the carriage 23 might collide against the left end wall 76 and that the meniscus of the nozzles 40 might be destroyed. In view of such a possibility, as in the above-described second velocity pattern, the carriage 23 is moved at a high velocity up to a position at which there is a row risk that the carriage 23 might collide against the left end wall 76 (namely, the first position), whereas the carriage 23 is moved at a low velocity in a position which is close to the left end wall 76 (namely, the range from the first position to the second position), thereby making it possible to shorten the time for executing the first moving processing and to protect the meniscus at the same time.

Further, according to the above-described embodiment, in the second moving processing, the third velocity pattern is adopted in a case that the FLS shot count is small, whereas the fourth velocity pattern is adopted in a case that the FLS shot count is large. With this, since the waiting time until the initial setting processing is executed becomes small in such a case that the FLS shot count is small, the FPOT can be further shortened. On the other hand, in the case that the FLS shot count is large, the carriage 23 is moved at a low velocity in the area in which the carriage 23 faces the ink receiving section 75, and thus the ink can be jetted in a required ink amount in an ensured manner. Namely, it is possible to shorten the FPOT while maintaining the quality of image recording at the same time. Note that the combination of the maximum velocities in the first to fourth velocity patterns is not limited to or restricted by the above-described examples.

Furthermore, according to the above-described embodiment, as the FLS shot count is greater, the flushing processing is started at a position farther away from the sheet facing area. With this, the ink can be jetted in an amount required for maintaining the quality of image recording in the recording processing, in an ensure manner. Here, there is such a possibility that the ink flying in the air might be misted and might dirty or contaminate the multi-function peripheral 10. In view of such a possibility, it is preferred that in the flushing processing the ink is made to land on a predetermined area in each of the guide walls 75B and 75C, thereby allowing the ink to trickle or flow on the guide walls 75B and 75C and to be discharged downwardly.

Accordingly, as in the above-described configuration, in the flushing processing in which the FLS shot count is small, it is preferred that the ink is jetted at a timing at which the ink lands on the first area $A_3$ most suitable for suppressing the misting of the ink. On the other hand, in the flushing processing in which the FLS shot count is great, the ink is jetted at a timing at which the ink lands on the second area $B_3$ which is wider in the downward direction than the first area $A_3$, thereby making it possible to jet the ink in the ink amount required for securing the quality of image recording, in the ensured manner.

Moreover, according to the embodiment, as the elapsed time T is longer, the FLS shot count becomes greater, whereas as the elapsed time T is shorter, the FLS shot count becomes smaller. With this, it is possible to jet the ink in the ink amount required for securing the quality of image recording in the ensured manner, and to suppress any wasteful jetting of the ink. Note that, however, the parameter for determining the FLS shot count is not limited to or restricted by the elapsed time T.

As another example, the controller 130 may determine the FLS shot count to be greater as the temperature around the recording head 39 is lower. As yet another example, the controller 130 may determine the FLS shot count to be greater as the humidity around the recording head 39 is lower. The temperature and humidity around the recording head 39 may be detected, for example, by a sensor mounted on the carriage 23, etc. Further, the parameter for determining the FLS shot count is not limited to one, and may be determined by combining the above-described plurality of parameters.

Further, according to the embodiment, since the nozzles 40 are covered by the cap 71 until the preceding command is received, it is possible to suppress any drying of the ink inside the nozzles 40. With this, the ink amount to be jetted in the flushing processing is reduced, thereby contributing to the shortening of the FPOT. Note that, however, the movement starting position for the carriage 23 in the first moving processing is not limited to the maintenance position. As another example, in a case that a next preceding command is received after the recording processing has been completed and before the carriage 23 is moved to the maintenance position, the movement starting position for the carriage 23 in the first moving processing may be any position in the sheet facing area.

Furthermore, according to the embodiment, the first preparing processing is started with the preceding command as a trigger. Namely, since the first preparing processing is executed in parallel with the generation of the raster data by the information processing apparatus 51, the FPOT can be shorted further. Note that, however, the trigger for starting the first preparing processing is not limited to or restricted by the preceding command. As another example, under a condition that the controller 130 receives the recording command, the controller 130 may start the first preparing processing. With this, even based on an instruction from an information processing apparatus 51 which does not have any function to transmit the preceding command, the recording processing can be executed.

<Modification>

Figure 11:
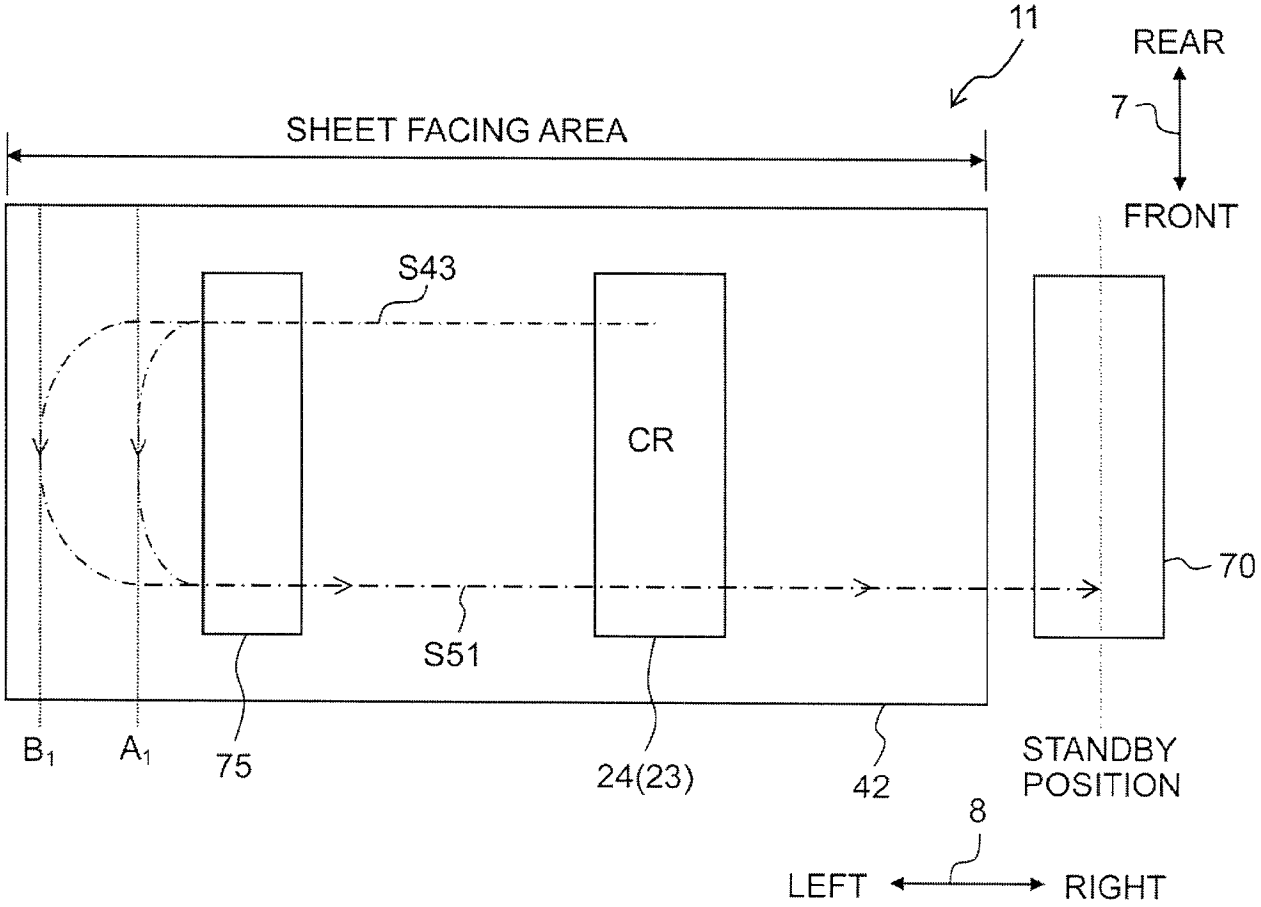
FIG. 11 is a plane view of a printer 11 according to a modification.

Next, with reference to FIG. 11, the configuration of a printer 11 according to a modification will be explained. Note that the explanation for any common point or features to those of the above-described embodiment will be omitted, and only the difference between the modification and the embodiment will be explained. The printer 11 as depicted in FIG. 11 is different from that of the embodiment in that an ink receiving section 75 is arranged within a range in the left/right direction 9 of the sheet facing area. Further, in the example depicted in FIG. 11, positions $A_1$ and $B_1$ each of which may be the returning position are also located within the sheet facing area.

In the first moving processing, a controller 130 according to the modification causes the carriage 23 located on the right side relative to the ink receiving section 75 (typically, at a position facing the maintenance mechanism 70) to move leftwardly up to the returning position $A_1$ or $B_1$. Further, in the second moving processing, the controller 130 causes the carriage 23 at the returning position $A_1$ or $B_1$ to move rightwardly up to a standby position on the right side relative to the ink receiving section 75 (typically, at the position facing the maintenance mechanism 70). Then, the controller 130 executes the flushing processing in a process during which the controller 130 moves the carriage 23 in the second moving processing. Further, under a condition that the carriage 23 has reached the standby position, the controller 130 executes the initial setting processing.

As in the modification, even in the printer 11 in which the ink receiving section 75 is arranged within the range of the sheet facing area, the moving distance across which the carriage 23 is moved in each of the first and second moving processings can be increased or decreased, depending on the FLS shot count. As a result, is it possible to shorten the FPOT while maintaining the quality of image recording at the same time. Note that the movement starting position of the carriage 23 in the first moving processing and the standby position as the movement ending position of the carriage 23 in the second moving processing are not limited to or restricted by the above-described examples.

What is claimed is:

1. An ink-jet printer comprising:

a conveyer configured to convey a sheet in a conveyance direction;

a recording head including a plurality of nozzles;

a carriage having the recording head mounted thereon and configured to reciprocate in a scanning direction crossing the conveyance direction;

an ink receiver; and a controller configured to control the conveyer, the recording head and the carriage so as to execute:

receiving a recording instruction for recording an image on a sheet;

in response to receipt of the recording instruction, determining an elapsed time elapsed since the ink has been jetted immediately therebefore;

moving the carriage in the first orientation of the scanning direction up to a returning position corresponding to the determined elapsed time;

moving the carriage in a second orientation of the scanning direction, which is opposite to the first orientation, from the returning position up to the sheet facing area;

executing a flushing processing for causing the ink to be jetted from the plurality of nozzles toward the ink receiver in a process in which the carriage is being moved in the second orientation of the scanning direction from the returning position up to the sheet facing area; and executing recording of the image by causing the ink to be jetted from the plurality of nozzles toward the sheet, conveyed by the conveyer, after the carriage has reached the sheet facing area, wherein the returning position is located at a first position downstream from the sheet facing area in the first orientation of the scanning direction, under a condition that the determined elapsed time is less than a threshold value, and the returning position is located at a second position downstream from the first position in the first orientation of the scanning direction, under a condition that the determined elapsed time is not less than the threshold value.

2. The ink-jet printer according to claim 1, further comprising a contact portion configured to make contact with the carriage, under a condition that the carriage is located at a contact position downstream from the second position in the first orientation of the scanning direction, wherein in a case that the returning position is the first position and that the carriage is to be moved downstream in the first orientation of the scanning direction up to the returning position, the controller is configured to execute moving the carriage in a first velocity pattern of which maximum velocity is a first velocity, and in a case that the returning position is the second position and that the carriage is to be moved downstream in the first orientation of the scanning direction up to the returning position, the controller is configured to execute moving the carriage in a second velocity pattern of which maximum velocity up to a specific position upstream from the second position in the first orientation of the scanning direction is the first velocity, and of which maximum velocity from the specific position up to the second position is a second velocity slower than the first velocity.

3. The ink-jet printer according to claim 2, wherein the first velocity pattern includes an acceleration segment in which the carriage is accelerated up to the first velocity, a first constant velocity segment in which the carriage is moved at the first velocity, and a first deceleration segment in which the carriage, being moved at the first velocity, is decelerated to stop the carriage at the first position, and the second velocity pattern includes the acceleration segment, the first constant velocity segment, a switching segment in which moving velocity of the carriage at the specific position is switched from the first velocity to the second velocity, a second constant velocity segment in which the carriage is moved at the second velocity, and a second deceleration segment in which the carriage, being moved at the second velocity, is decelerated to stop the carriage at the second position.

4. The ink-jet printer according to claim 2, wherein the specific position is the first position.

5. The ink-jet printer according to claim 1, wherein in a case that the returning position is the first position and in the process in which the carriage is being moved in the second orientation of the scanning direction from the returning position up to the sheet facing area, the controller is configured to execute moving the carriage in a third velocity pattern of which maximum velocity is a third velocity, and in a case that the returning position is the second position and in the process in which the carriage is being moved in the second orientation of the scanning direction from the returning position up to the sheet facing area, the controller is configured to execute moving the carriage in a fourth velocity pattern of which maximum velocity until the flashing processing is completed is a fourth velocity slower than the third velocity, and of which maximum velocity after the flushing processing is completed is the third velocity.

6. The ink-jet printer according to claim 5, further comprising a sensor mounted on the carriage and configured to detect the sheet conveyed by the conveyer, wherein in the process in which the carriage is being moved in the second orientation of the scanning direction from the returning position up to the sheet facing area, and under a condition that the carriage reaches the sheet facing area, the controller is configured to execute a cue-feeding processing for causing the conveyer to convey the sheet up to a facing position at which an area, of the sheet, in which the image is to be recorded first faces the recording head, and the controller is configured to execute the recording of the image, under a condition that the sensor detects the sheet in the cue-feeding processing and that the cue-feeding processing is completed.

7. The ink-jet printer according to claim 1, wherein in a case that the returning position in the flushing processing is the first position, the controller is configured to execute the flushing processing in a case that the carriage reaches a third position located downstream from the first position in the second orientation of the scanning direction, and in a case that the returning position in the flushing processing is the second position, the controller is configured to execute the flushing processing in a case that the carriage reaches a fourth position located upstream from the third position in the second orientation of the scanning direction.

8. The ink-jet printer according to claim 1, wherein the ink receiver includes a guide wall crossing the scanning direction, wherein in the flushing processing in a case that the returning position is the first position, the controller is configured to cause the ink to be jetted from the plurality of nozzles in a case that the ink lands on a first area of the guide wall, and in the flushing processing in a case that the returning position is the second position, the controller is configured to cause the ink to be jetted from the plurality of nozzles in a case that the ink lands on a second area of the guide wall, the second area corresponding to the first area being extended downwardly.

9. The ink-jet printer according to claim 1, wherein the controller is configured to determine an ink amount to be jetted in the flushing processing to be great under a condition that the elapsed time, elapsed since the ink has been jetted immediately therebefore, is long.

10. The ink-jet printer according to claim 1, further comprising: a cap arranged at a position downstream from the sheet facing area in the second orientation of the scanning direction; and a moving mechanism configured to change a relative position of the cap relative to the recording head, between a covering position at which the cap makes contact with the recording head to cover the plurality of nozzles and a separate position at which the cap is separated away from the recording head, wherein the controller is configured to execute, in response to receipt of the recording command, changing the relative position of the cap relative to the recording head from the covering position to the separate position, and the controller is configured to execute, in response that the cap and the recording head are separated away from each other, the moving of the carriage in the first orientation of the scanning direction up to the returning position.

11. The ink-jet printer according to claim 1, further comprising a communicating section configured to receive a command, transmitted by an external apparatus, as the recording instruction, wherein the command includes a recording command including an image data indicating an image to be recorded on the sheet, and a preceding command previously notifying transmittance of the recording command, the controller is configured to execute, in response to receipt of the preceding command via the communicating section, the determining of the elapsed time and the moving of the carriage in the first orientation of the scanning direction up to the returning position, and the controller is configured to execute, in response to receipt of the recording command via the communicating section, the moving of the carriage in the second orientation of the scanning direction from the returning position up to the sheet facing area, the executing of the flushing processing, and recording, on the sheet, the image indicated by the image data included in the recording command.

* * * * *